US007242373B2

(12) United States Patent
Tomio et al.

(10) Patent No.: US 7,242,373 B2
(45) Date of Patent: Jul. 10, 2007

(54) CIRCUIT FOR DRIVING FLAT DISPLAY DEVICE

(75) Inventors: Shigetoshi Tomio, Kawasaki (JP); Tomokatsu Kishi, Kawasaki (JP); Tetsuya Sakamoto, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 823 days.

(21) Appl. No.: 09/988,246

(22) Filed: Nov. 19, 2001

(65) Prior Publication Data

US 2002/0097237 A1 Jul. 25, 2002

(30) Foreign Application Priority Data

Jan. 19, 2001 (JP) ..... 2001-012420

(51) Int. Cl.
*G09G 3/28* (2006.01)

(52) U.S. Cl. ..... 345/60; 345/67; 345/211; 345/204; 315/169.4

(58) Field of Classification Search ..... 345/60–69, 345/74.01–77, 79, 80–103, 208–210, 212, 345/211, 691, 692, 693, 204; 315/169.1, 315/169.3, 169.4; 348/797–799; 313/586, 313/484

See application file for complete search history.

(56) References Cited

U.S. PATENT DOCUMENTS 4,707,692 A 11/1987 Higgins et al.
5,745,086 A * 4/1998 Weber ..... 345/63
6,249,087 B1 * 6/2001 Takayama et al. ..... 315/169.1
6,466,186 B1 10/2002 Shimizu et al.
6,483,250 B1 * 11/2002 Hashimoto et al. ..... 315/169.4
6,492,776 B2 * 12/2002 Rutherford ..... 315/169.1
6,567,059 B1 * 5/2003 Ide ..... 345/60
6,686,912 B1 * 2/2004 Kishi et al. ..... 345/211
6,867,552 B2 * 3/2005 Takamori et al. ..... 315/169.4
6,937,213 B2 * 8/2005 Iwasa et al. ..... 345/60
7,006,057 B2 * 2/2006 Jin et al. ..... 345/60
7,102,598 B2 * 9/2006 Onozawa et al. ..... 345/61

FOREIGN PATENT DOCUMENTS

EP 0 704 834 4/1996
EP 0 865 021 9/1998
EP 1 065 650 A2 1/2001
JP 2000/172223 6/2000

OTHER PUBLICATIONS

European Search Report, mailed Mar. 1, 2007, and issued in corresponding European Patent Application No. 01309857.9-1228.

* cited by examiner

*Primary Examiner*—Lun-Yi Lao
(74) *Attorney, Agent, or Firm*—Staas & Halsey LLP

(57) ABSTRACT

A ramp waveform generation circuit for generating a ramp waveform to be applied to a capacitive load serving as a display element is connected between the ground and a signal line for supplying a high-level voltage generated by a power supply circuit for generating a voltage to be applied to the capacitive load, thereby operating the ramp waveform generation circuit with reference to the ground potential. Hence, without using a plurality of power supply circuits or a signal transmission circuit for converting the reference potential of a control signal for the ramp waveform generation circuit, a stable ramp waveform can be output with a simple circuit arrangement.

16 Claims, 17 Drawing Sheets

CIRCUIT FOR DRIVING FLAT DISPLAY DEVICE

CROSS-REFERENCE TO RELATED APPLICATIONS

This application is based upon and claims priority of Japanese Patent Application No. 2001-012420, filed on Jan. 19, 2001, the contents being incorporated herein by reference.

BACKGROUND OF THE INVENTION

1. Field of the Invention

The present invention relates to a circuit for driving a flat display device and, more particularly, to an AC-driven plasma display driving circuit.

2. Description of the Related Art

Conventionally, AC-driven PDPs (Plasma Display Panels) as one of flat display devices are classified into two-electrode type PDPs which perform selective discharge (address discharge) and sustain discharge using two electrodes and three-electrode type PDPs which perform address discharge using a third electrode. The three-electrode type PDPs are further classified into a type with the third electrode formed on a substrate on which the first and second electrodes for performing sustain discharge are laid out and a type with the third electrode formed on another substrate opposite to the substrate of the first and second electrodes.

All types of the above PDP devices are based on the same operation principle. The arrangement of a PDP device in which the first and second electrodes for performing sustain discharge are formed on the first substrate, and the third electrode is formed on the second substrate opposite to the first substrate will be described below.

FIG. 13 is a view showing the overall arrangement of an AC-driven PDP device. In an AC-driven PDP device 1 shown in FIG. 13, a plurality of cells each corresponding to one pixel of a display image are arrayed in a matrix. FIG. 13 shows an AC-driven PDP device having cells arrayed in a matrix with m rows by n columns. The AC-driven PDP 1 also has scanning electrodes Y1 to Yn and common electrodes X, which are formed to run parallel on the first substrate, and address electrodes A1 to Am which are formed on the second substrate opposite to the first substrate so as to run perpendicular to the electrodes Y1 to Yn and X. The common electrodes X are formed in proximities of the scanning electrodes Y1 to Yn in correspondence with them and commonly connected at terminals on one side.

The common terminal of the common electrodes X is connected to the output terminal of an X-side circuit 2. The scanning electrodes Y1 to Yn are connected to the output terminals of a Y-side circuit 3. The address electrodes A1 to Am are connected to the output terminals of an address-side circuit 4. The X-side circuit 2 is formed from a circuit for repeating discharge. The Y-side circuit 3 is formed from a circuit for executing line-sequential scanning and a circuit for repeating discharge. The address-side circuit 4 is formed from a circuit for selecting a column to be displayed. The X-side circuit 2, Y-side circuit 3, and address-side circuit 4 are controlled by control signals supplied from a control circuit 5. That is, a cell to be turned on is determined by the address-side circuit 4 and the line-sequential scanning circuit in the Y-side circuit 3, and discharge is repeated by the X-side circuit 2 and Y-side circuit 3, thereby executing the display operation of the PDP.

The control circuit 5 generates the control signals on the basis of display data D from an external device, a clock CLK indicating the read timing of the display data D, a horizontal sync signal HS, and a vertical sync signal VS and supplies the control signals to the X-side circuit 2, Y-side circuit 3, and address-side circuit 4.

FIG. 14A is a sectional view of a cell Cij as a Pixel, which is in the ith row and jth column. Referring to FIG. 14A, the common electrode X and scanning electrode Yi are formed on a front glass substrate 11. The electrodes are coated with a dielectric layer 12 that insulates the electrodes from a discharge space 17. The dielectric layer 12 is coated with an MgO (magnesium oxide) protective film 13.

On the other hand, the address electrode Aj is formed on a back glass substrate 14 opposite to the front glass substrate 11. The address electrode Aj is coated with a dielectric layer 15, and the dielectric layer 15 is coated with a phosphor 18. Ne+Xe Penning gas is sealed in the discharge space 17 between the MgO protective film 13 and the dielectric layer 15.

FIG. 14B is a view for explaining a capacitance Cp of the AC-driven PDP. As shown in FIG. 14B, in the AC-driven PDP, capacitive components Ca, Cb, and Cc are present in the discharge space 17, between the common electrode X and the scanning electrode Y, and in the front glass substrate 11, respectively. A capacitance Cpcell per cell is determined by the sum of the capacitive components (Cpcell=Ca+Cb+Cc). The sum of capacitances Cpcell of all cells in the panel corresponds to the panel capacitance Cp.

FIG. 14C is a view for explaining light emission of the AC-driven PDP. As shown in FIG. 14C, stripe-shaped red, blue, and green phosphors 18 are laid out and applied to the inner surfaces of ribs 16. The phosphors 18 are excited by discharge between the common electrode X and the scanning electrode Y so as to emit light.

FIG. 15 is a timing chart showing a conventional method of driving an AC-driven PDP. FIG. 15 shows one of a plurality of subfields of one frame. One subfield is divided into a reset period comprised of a full write period and full erase period, an address period, and a sustain discharge period.

In the reset period, all the scanning electrodes Y1 to Yn are set at the ground level (0 V), and simultaneously, a full write pulse having a voltage Vs+Vw (about 400 V) is applied to the common electrodes X. At this time, all the address electrodes A1 to Am have a potential Vaw (about 100 V). Consequently, discharge occurs in all cells of all display lines to generate wall charges independently of the preceding display state.

Next, the potentials of the common electrodes X and address electrodes A1 to Am change to 0 V. As the voltage of wall charges themselves exceeds the discharge start voltage in all cells, discharge starts. In this discharge, no wall charges are formed because the electrodes have no potential difference. Space charges cause so-called self-erase discharge and neutralize by themselves to end the discharge. With this operation, all cells in the panel are set in a uniform state free from wall charges. The reset period acts to set all cells in the same state independently of the ON/OFF state of each cell in the preceding subfield. This makes it possible to stably perform the subsequent address (write) discharge.

In the address period, address discharge is line-sequentially performed to turn on/off each cell in accordance with display data. First, a voltage of −Vy level (about −150 V) is applied to the scanning electrode Y1 corresponding to the first display line, and a voltage of −Vsc level (about −50 V)

is applied to the scanning electrodes Y2 to Yn corresponding to the remaining display lines. At the same time, an address pulse having a voltage Va (about 50 V) is selectively applied to the address electrode Aj (j is an arbitrary number, $1 \leqq j \leqq m$) corresponding to a cell which should cause sustain discharge, i.e., a cell to be turned on in the address electrodes A1 to Am.

As a result, discharge occurs between the scanning electrode Y1 and the address electrode Aj of the cell to be turned on. With this priming (pilot flame), discharge between the scanning electrode Y1 and the common electrode X having a voltage Vx (about 50 V) immediately starts. With this discharge, wall charges in an amount enough for the next sustain discharge are accumulated on the surface of the MgO protective film 13 on the common electrode X and scanning electrode Y1 of the selected cell. For the scanning electrodes Y2 to Yn corresponding to the remaining display lines as well, the voltage of −Vy level is sequentially applied to a scanning electrode corresponding to a selected cell, and the voltage of −Vsc level is applied to the scanning electrode corresponding to each of remaining, unselected cells. With this processing, new display data is written in all display lines.

In the subsequent sustain discharge period, a sustain pulse having a voltage Vs (about 200 V) is alternately applied to the scanning electrodes Y1 to Yn and common electrodes X to perform sustain discharge so that an image of one subfield is displayed. The luminance of the image is determined by the length of the sustain discharge period, i.e., the number of times of application or the frequency of sustain pulses.

In the AC-driven PDP, a voltage Vf at which gas discharge starts on the surface between the common electrode X and the scanning electrode Y is generally 220 to 260 V. The scanning electrode Y is an arbitrary one of the above-described scanning electrodes Y1 to Yn. In the address period, for example, a voltage is applied between the address electrode A and the scanning electrode Y of a cell to be displayed such that gas discharge occurs. This triggers discharge between the common electrode X and the scanning electrode Y so as to generate wall charges on the common electrode X and scanning electrode Y in that cell.

Next, in the sustain discharge period, $|Vs+Vwall|$ is increased to Vf or more by the sustain pulse voltage Vs applied between the common electrode X and the scanning electrode Y together with wall charges Vwall generated in the address period, thereby performing gas discharge. The value of the voltage Vs does not exceed the discharge start voltage Vf, and a voltage value that satisfies $|Vs|<|Vf|<|Vs+Vwall|$ is defined as Vs.

When gas discharge occurs between the common electrode X and the scanning electrode Y, wall charges on the common electrode X and the scanning electrode Y in that cell obtain an opposite polarity to stop the gas discharge. The sustain pulse voltage Vs having an opposite polarity is applied between the common electrode X and the scanning electrode Y, thereby performing gas discharge again using the wall charges formed on the common electrode X and the scanning electrode Y. When the above operation is repeated, gas discharge can be repeatedly performed.

However, to drive an AC-driven PDP by the above-described drive method, drive voltages according to the timing chart shown in FIG. 15 must be applied to the respective electrodes, and each element of the AC-driven PDP driving circuit must have a high breakdown voltage. Especially, a circuit for applying a full write pulse voltage Vs+Vw (about 400 V) shown in FIG. 15 to the X-electrode must be constructed using elements having a very high breakdown voltage corresponding to the full write pulse voltage. For this reason, an expensive and large switch element such as an FET must be used to ensure a sufficient breakdown voltage. This complicates the circuit arrangement and considerably increases the manufacturing cost.

As a solution to this problem, an AC-driven PDP driving method has been proposed, in which in performing discharge between the electrodes of an AC-driven PDP, a positive voltage is applied to one electrode, and a negative voltage is applied to the other electrode, thereby causing discharge between the electrodes using the potential difference between them.

FIG. 16 is a circuit diagram showing the arrangement of a driving circuit for implementing a method of driving an AC-driven PDP which performs discharge between electrodes using the potential difference between them. Referring to FIG. 16, a load 20 is the total capacitance of a cell formed between one common electrode X and one scanning electrode Y. The common electrode X and scanning electrode Y are formed on the load 20.

Switches SW1 and SW2 of a circuit on the common electrode X side are connected in series between the power supply line of a voltage (Vs/2) supplied from a power supply circuit (not shown) and the ground (GND) An interconnection node between the two switches SW1 and SW2 is connected to one terminal of a capacitor C1. A switch SW3 is connected between the GND and the other terminal of the capacitor C1.

Switches SW4 and SW5 are connected in series between the two terminals of the capacitor C1. An interconnection node between the two switches SW4 and SW5 is connected to the common electrode X of the load 20. A switch SW6 applies a voltage Vx' (=Vs/2+Vx) to the common electrode X. The switch SW6 is connected in series between the power supply line of the voltage Vx' supplied from a power supply circuit (not shown) and a second signal line OUTB.

A diode D4 flows a current from the GND to the load 20 through the common electrode X at a timing when the positive voltage (+Vs/2) applied to the scanning electrode Y is returned to the ground level. A diode D5 flows a current from the load 20 to the GND through the common electrode X at a timing when the positive voltage (+Vs/2) is applied to the scanning electrode Y.

Switches SW1' and SW2' of a circuit on the scanning electrode Y side are connected in series between the power supply line of the voltage (Vs/2) supplied from the power supply circuit (not shown) and the ground (GND). An interconnection node between the two switches SW1' and SW2' is connected to one terminal of a capacitor C2. A switch SW3' is connected between the GND and the other terminal of the capacitor C2.

A switch SW4' connected to the one terminal of the capacitor C2 is connected to the cathode of a diode D7. The anode of the diode 07 is connected to the other terminal of the capacitor C2. A switch SW5' connected to the other terminal of the capacitor C2 is connected to the anode of a diode D6. The cathode of the diode D6 is connected to the one terminal of the capacitor C2.

One terminal of the switch SW4' connected to the cathode of the diode D7 and one terminal of the switch SW5' connected to the anode of the diode D6 are connected to the load 20 through a scan driver 21. The scan driver 21 has a series circuit of two transistors. An interconnection node between the two transistors is connected to the scanning electrode Y of the load 20. The scan driver 21 is prepared for each of a plurality of display lines of the PDP.

A switch SW7 applies to the scanning electrode Y a voltage Vw' (=Vs/2+Vw) for executing a write in all cells of the PDP. The switch SW7 is connected in series between the power supply line of the voltage Vw' supplied from a power supply circuit (not shown) and a fourth signal line OUTB'. The switch SW7 has a resistor R1. The applied voltage is continuously changed by the function of the resistor R1 along with the elapse of time, thereby applying the voltage Vw' to the scanning electrode Y.

Switches SW8 and SW9 give a potential difference of (Vs/2) across the scan driver 21 during the address period. That is, during the address period, the switches SW2' and SW8 are turned on to set the voltage on the upper side of the scan driver 21 at the ground level. In addition, the switch SW9 is turned on to apply a negative voltage −Vy supplied from the connected power supply circuit to the lower side of the scan driver 21 through the fourth signal line OUTB'. In this way, in outputting the scanning electrode Y corresponding to a line-sequentially selected display line, the negative voltage −Vy is applied to the scanning electrode Y by the scan driver 21.

After the voltage Vw' is applied to the scanning electrode Y in the reset period, a ramp wave generation circuit 22 applies the voltage −Vy to the scanning electrode Y to perform erase operation for all cells of the PDP. The ramp wave generation circuit 22 has a switch SW11 connected in series between the power supply line of the voltage −Vy supplied from the power supply circuit (not shown) and the upper side of the scan driver 21. The switch SW11 has a resistor R2. By the function of the resistor R2, the applied voltage is continuously changed from the voltage Vw' to the voltage −Vy along with the elapse of time.

FIG. 17 is a circuit diagram showing the detailed circuit arrangement of the ramp wave generation circuit 22. Referring to FIG. 17, the same reference numerals as in FIG. 16 denote parts having the same functions as in FIG. 16, and a repetitive description will be omitted.

Referring to FIG. 17, a photocoupler 23 converts the reference level of a control signal for the switch SW11, which is supplied from a drive signal generation circuit (not shown), from the ground level to the −Vy potential level, i.e., the reference level of the switch SW11. A MOS driver 24 for driving the switch SW11 shifts the level of the control signal for the switch SW11, which is level-converted by the photocoupler 23, to the gate drive level of the switch SW11 and supplies the control signal to the switch SW11. The MOS driver 24 has two transistors Tr11 and Tr12. The transistors Tr11 and Tr12 are ON/OFF-controlled in accordance with the control signal for the switch SW11, which is level-converted by the photocoupler 23, thereby supplying the drive voltage for the switch SW11 to the switch SW11.

A power supply circuit 26 generates the voltage −Vy as the reference potential of each element of the ramp wave generation circuit 22. A floating power supply 25 generates a voltage Ve using the potential −Vy generated by the power supply circuit 26 as a reference level and supplies the voltage Ve. The voltage Ve using the potential −Vy as a reference level is supplied to the output portion (light-receiving element) of the photocoupler 23 and the MOS driver 24. That is, the floating power supply 25 supplies the gate voltage of the switch SW11.

FIG. 18 is a timing chart showing an example of an AC-driven PDP driving method using the driving circuit shown in FIGS. 16 and 17. FIG. 18 shows one of a plurality of subfields of one frame, as in FIG. 15 described above. For the description of FIG. 18, assume that charges corresponding to the voltage (Vs/2) are accumulated in the capacitor C1 on the common electrode X side and in the capacitor C2 on the scanning electrode Y side by processing of the preceding subfield.

In the reset period, first, on the common electrode X side, the switches SW2 and SW5 are turned on, and the switches SW1, SW3, SW4, and SW6 are turned off. The voltage of the second signal line OUTB is reduced to (−Vs/2) in accordance with the charges accumulated in the capacitor Cl. The voltage is output to an output line OUTC through the switch SW5, so the negative voltage (−Vs/2) is applied to the common electrode X.

Simultaneously, on the scanning electrode Y side, the switch SW7 is turned on, and the switches SW1' to SW5', SW8, SW9, and SW11 are turned off. The positive voltage Vw' (=Vs/2+Vw) is applied to all the scanning electrodes Y. With this operation, a potential difference between the common electrode X and scanning electrode Y have a potential difference corresponds to the full write pulse voltage (Vs+Vw) shown in FIG. 15. The positive voltage (Vs/2+Vw) applied to the scanning electrode Y continuously changes along with the elapse of time. In the following description, unlike a waveform, such as a pulse applied to the electrode in the sustain discharge period, whose voltage changes in a short time, a ramp waveform whose voltage continuously changes in a sufficiently long time along with the elapse of time will be called a "ramp wave".

When such a ramp wave is applied, discharge sequentially occurs in cells where the potential difference between the Y-electrode and the common electrode X has reached the discharge start voltage during the rise of the ramp wave. Actually, discharge occurs in each cell at an optimum voltage (voltage almost equal to the discharge start voltage)

Next, on the common electrode X side, the switch SW5 is turned off, and the switch SW4 is turned on to set the voltage of the common electrode X at the ground level (0 V). After that, on the common electrode X side, the switch SW2 is turned off, and the switches SW5 and SW6 are turned on, thereby applying the positive voltage Vx' (Vs/2+Vx) to the common electrode X.

On the scanning electrode Y side, the switch SW7 is turned off, and the switch SW11 is turned on, thereby applying to the scanning electrode Y a ramp wave whose voltage gradually drops and finally reaches the negative voltage (−Vy). The negative voltage (−Vy) is about (−Vs/2). As the voltage of wall charges themselves exceeds the discharge start voltage in all cells, discharge starts. At this time as well, weak discharge occurs between the common electrode X and the scanning electrode Y in accordance with application of the ramp wave, so the accumulated wall charges are erased with some exceptions.

In the address period, address discharge is line-sequentially performed to turn on/off each cell in accordance with display data. At this time, on the common electrode X side, the switch SW2 is turned off, and the switches SW5 and SW6 are turned on, thereby applying the voltage Vx' to the common electrode X. For the scanning electrodes Y, the switches SW2', SW8, and SW9 are turned on to apply a voltage of (−Vs/2) level to each scanning electrode Y corresponding to a line-sequentially selected display line. In addition, the switches SW2' and SW8 are turned on to apply a voltage of the ground level to each unselected scanning electrode Y.

At this time, an address pulse having the voltage Va is selectively applied to the address electrode Aj in the address electrodes A1 to Am, which corresponds to a cell which should cause sustain discharge, i.e., a cell to be turned on. As a result, discharge occurs between the address electrode Aj of the cell to be turned on and the line-sequentially selected scanning electrode Y. With this priming (pilot flame), discharge between the common electrode X and the scanning electrode Y immediately starts. Wall charges in an amount enough for the next sustain discharge are accumulated on the MgO protective film on the common electrode X and scanning electrode Y of the selected cell.

When a ramp wave is applied in the full erase period in the reset period to perform weak discharge, discharge between the address electrode Aj and the scanning electrode Y is started by the potential difference (Va+Vs/2) between the electrodes. Since wall charges on the scanning electrode Y are not completely erased in the reset period and some wall charges are left, the discharge start voltage can be obtained by the residual wall charges and the actually applied voltage, and discharge starts.

In the sustain discharge period, when the switches SW6 to SW9 and SW11 are turned off, and the switches SW1 to SW5 on the common electrode X side and the switches SW1' to SW5' on the scanning electrode Y side are ON/OFF-controlled at appropriate timings, the voltage changes in an order of Vs/2→0 V→−Vs/2→0 V→Vs/2 . . . , so voltages with different phases are applied to the common electrode X and the scanning electrode Y of each display line. Hence, the potential difference between the common electrode X and the scanning electrode Y of each display line becomes equal to the sustain pulse voltage shown in FIG. 15, sustain discharge is performed, and an image of one subfield is displayed. During the sustain discharge period, the potentials of the address electrodes A1 to Am are kept at the ground level as the intermediate potential between the common electrode X and the scanning electrode Y.

In this way, when a positive voltage is applied to one electrode, and a negative voltage is applied to the other electrode using the driving circuit shown in FIGS. 16 and 17, a potential difference corresponding to each pulse shown in FIG. 15 can be generated between the electrodes. The breakdown voltage of each element of the driving circuit can be made lower as compared to a case wherein an AC-driven PDP is driven in accordance with the timing chart shown in FIG. 15.

In addition, when a ramp wave is applied in the full erase period in the reset period to perform weak discharge such that wall charges on the scanning electrode Y are not completely erased, and some wall charges are left, discharge between the address electrode Aj and the scanning electrode Y in the address period can be started by a potential difference (Va+Vs/2) lower than the conventional potential difference (Va+Vy). Hence, a cell to be turned on in the sustain discharge period can be accurately selected.

However, in the proposed PDP driving circuit, power supply circuits for externally supplying the voltage −Vy and the voltage −Vey must be separately arranged, as shown in FIG. 17. Furthermore, since the reference level of the control signal supplied to the ramp wave generation circuit 22 and that of the signal for driving the switch SW11 are different, a signal transmission circuit for converting the signal input with reference to the GND level into a signal with reference to −Ve, such as a photocoupler, must be prepared, and the circuit arrangement becomes very complex.

SUMMARY OF THE INVENTION

The present invention has been made to solve the above problem, and has as its object to output a stable ramp waveform while simplifying the circuit arrangement without using a plurality of power supply circuits or a signal transmission circuit for converting the reference potential of the control signal.

According to the present invention, there is provided a driving circuit for a flat display device, comprising a power supply circuit for generating a first voltage and a second voltage to be applied to a capacitive load serving as a display element using an externally supplied power supply, and a ramp waveform generation circuit connected between a first signal line supplying the first voltage and a second signal line supplying the second voltage generated by the power supply circuit so as to generate a ramp waveform to be applied to the capacitive load.

According to the present invention with the above arrangement, since the ramp waveform generation circuit is connected between the first signal line for supplying the voltage generated by the power supply circuit and the second signal line, the ramp waveform generation circuit can be operated with reference to the ground potential. Hence, a stable ramp waveform can be output without using a plurality of power supply circuits or a signal transmission circuit for converting the reference potential of a control signal for the ramp waveform generation circuit.

DETAILED DESCRIPTION OF THE PREFERRED EMBODIMENTS

The embodiments of the present invention will be described below with reference to the accompanying drawings.

(First Embodiment)

Figure 1:
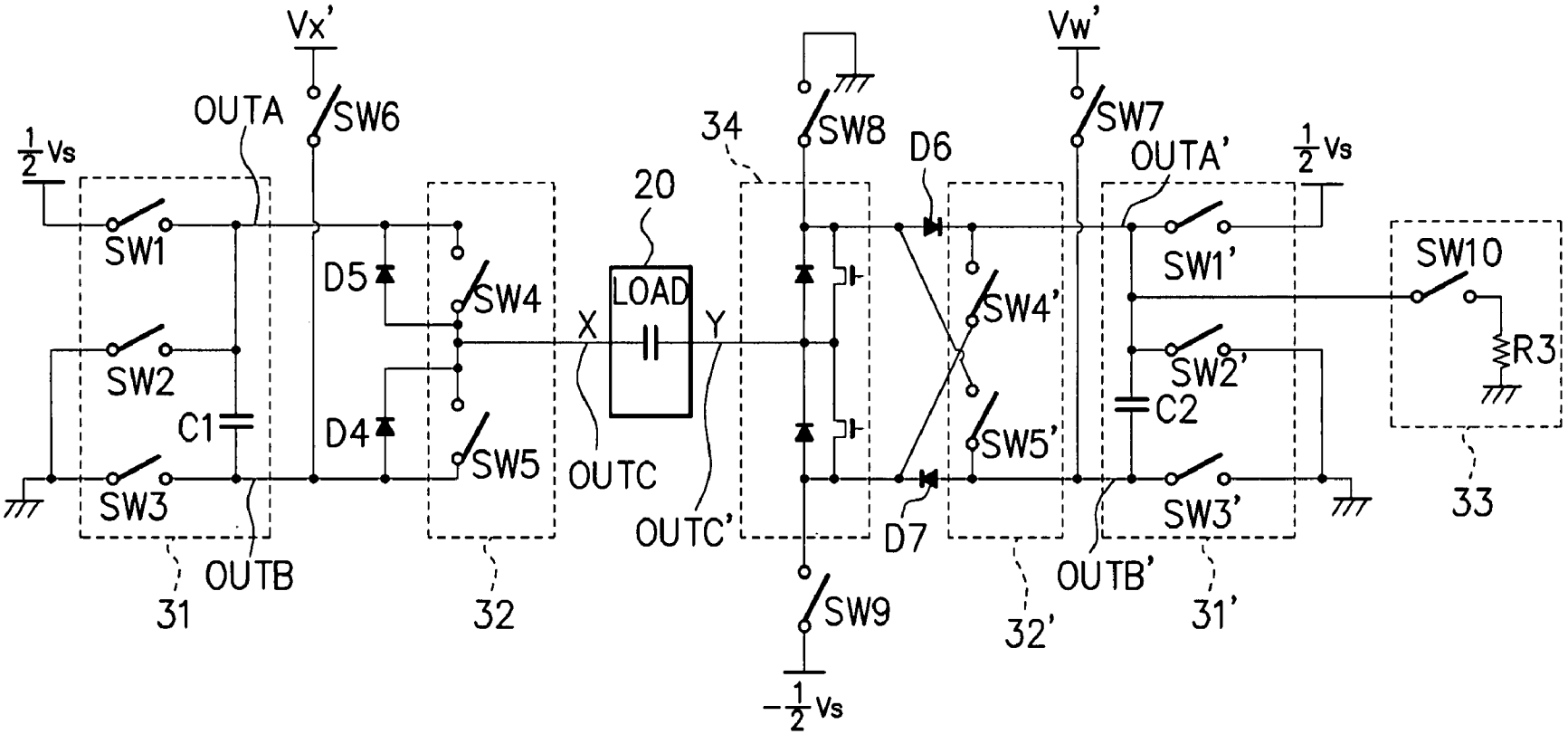
FIG. 1 is a circuit diagram showing the arrangement of an AC-driven PDP driving circuit according to the first embodiment.
Figure 13:
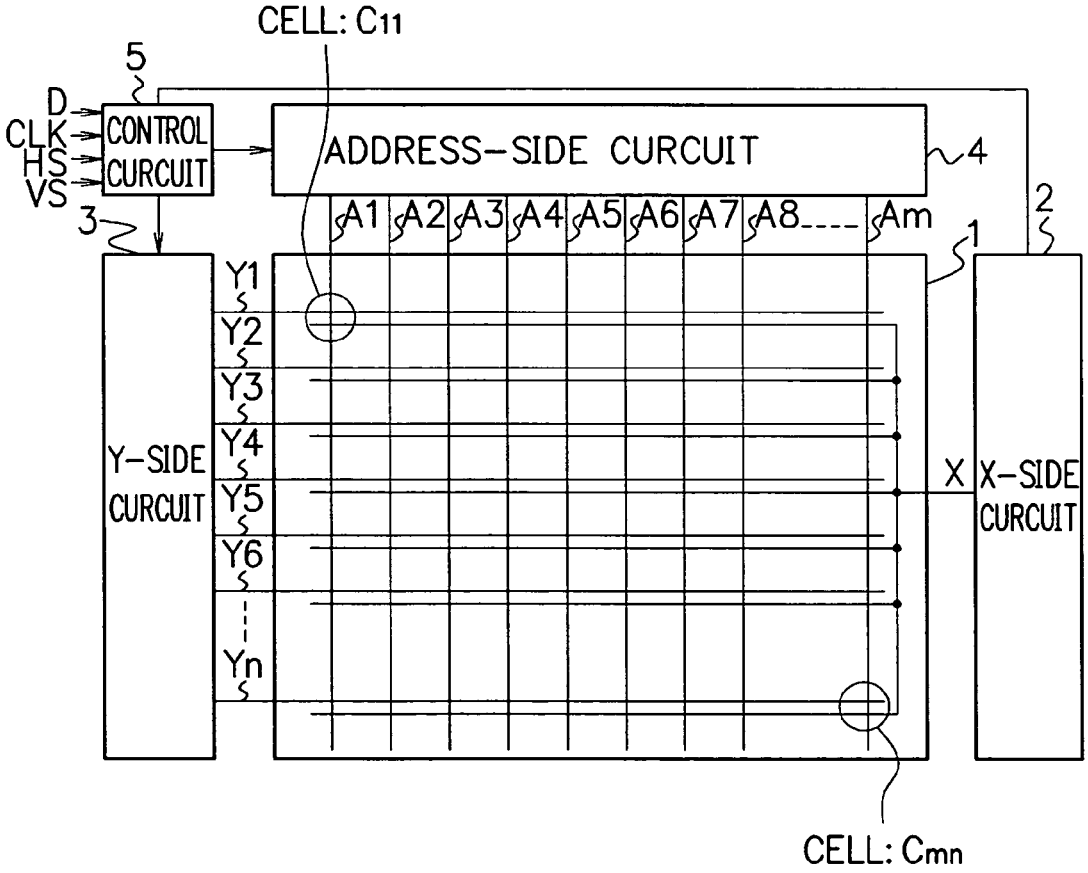
FIG. 13 is a view showing the overall arrangement of an AC-driven PDP device.
Figure 14A:
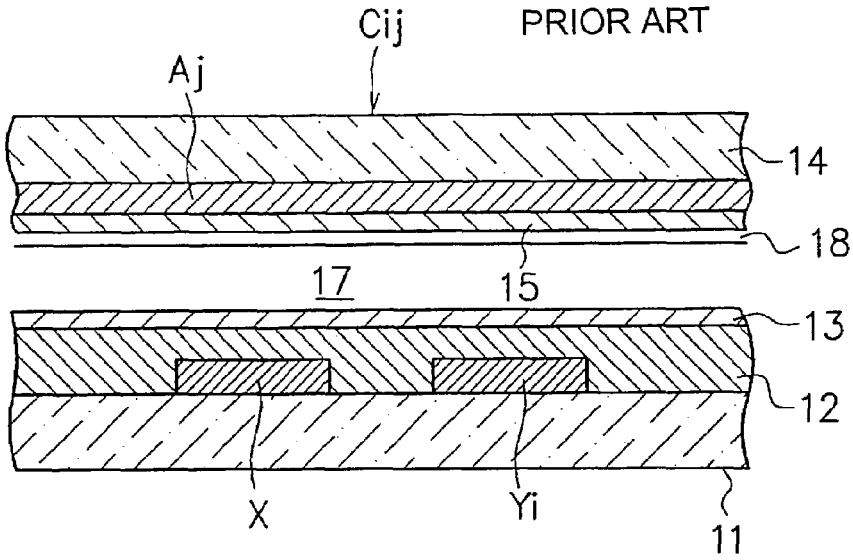
FIG. 14A is a sectional view showing the sectional structure of a cell Cij as a pixel, which is in the ith row and jth column.
Figure 14B:
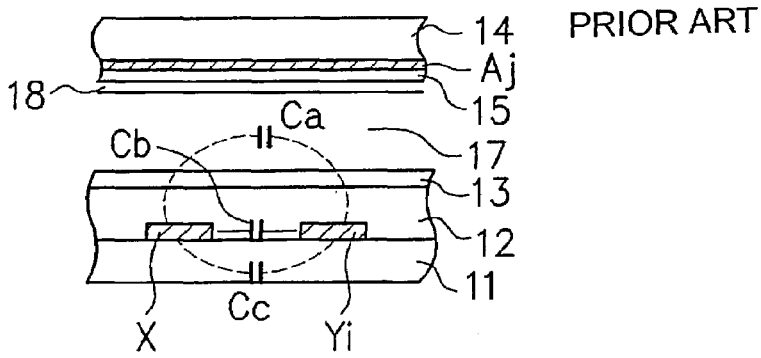
FIG. 14B is a view for explaining the capacitance of the AC-driven PDP.
Figure 14C:
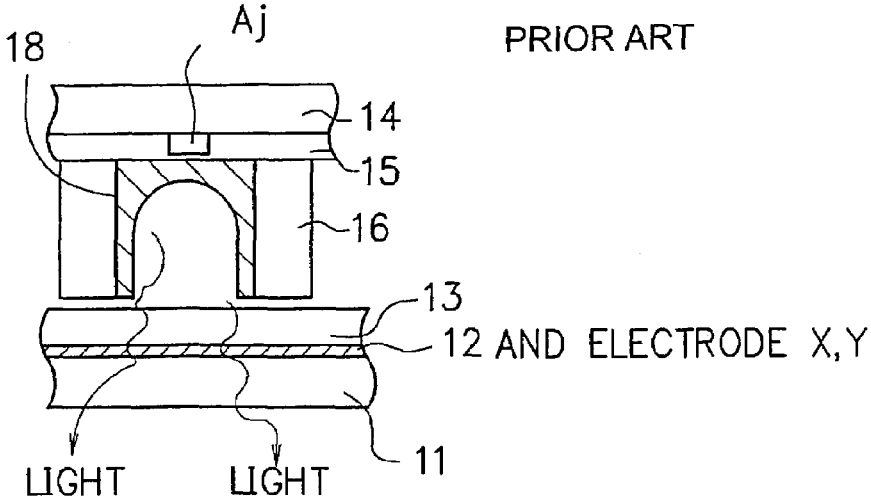
FIG. 14C is a view for explaining light emission of the AC-driven PDP.
Figure 15:
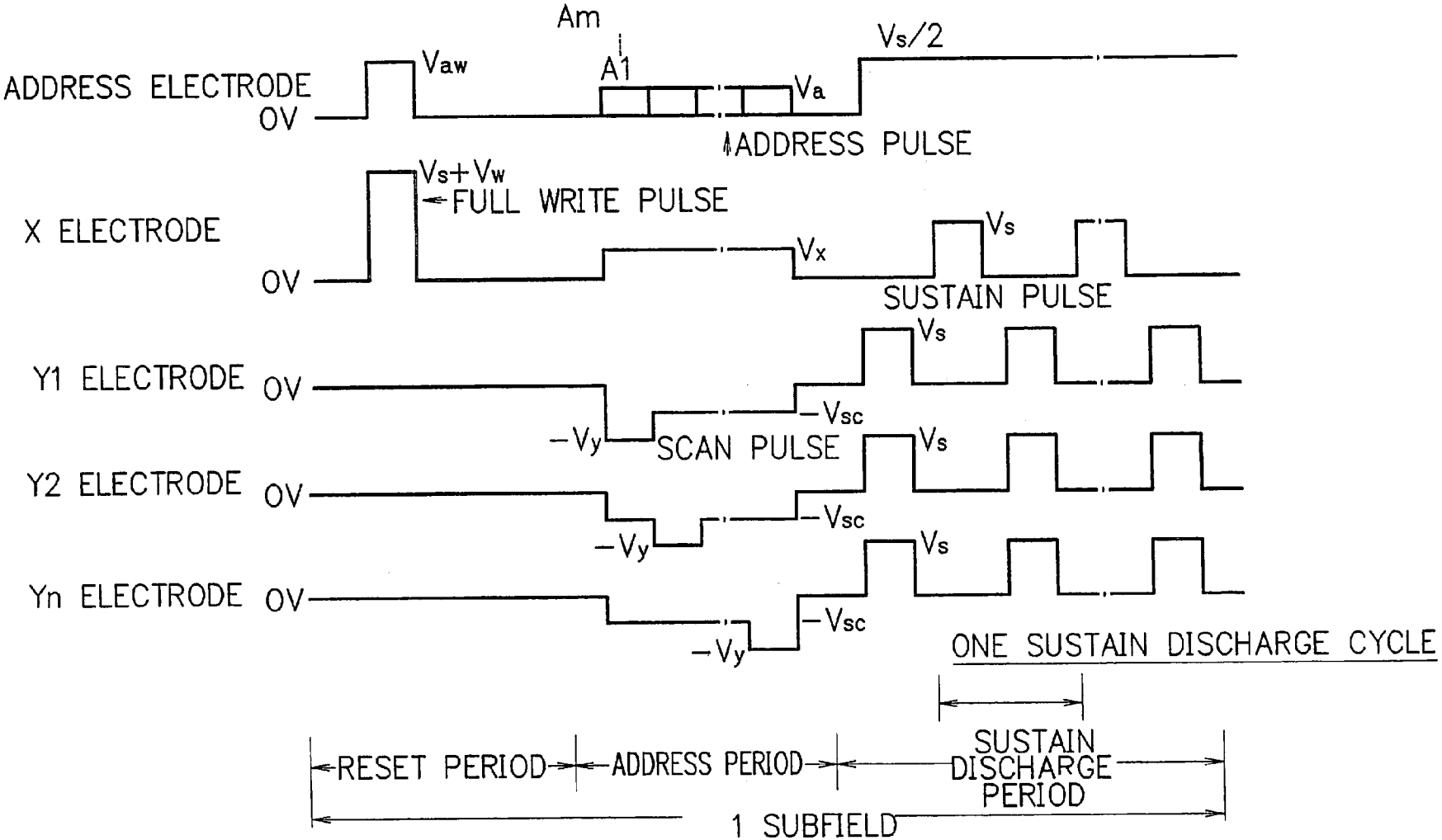
FIG. 15 PRIOR ART
FIG. 15 is a timing chart showing a conventional AC-driven PDP driving method.

FIG. 1 is a circuit diagram showing the arrangement of a driving circuit according to the first embodiment. The driving circuit shown in FIG. 1 is an AC-driven PDP driving circuit which implements a driving method for an AC-driven PDP as shown in FIGS. 13 and 14 described above, in which a positive voltage is applied to one electrode, and a negative voltage is applied to the other electrode, thereby performing discharge between the electrodes using the potential difference between them.

Referring to FIG. 1, a load 20 is the total capacitance of a cell formed between one common electrode X and one scanning electrode Y. The common electrode X and scanning electrode Y are formed on the load 20.

A power supply circuit 31 selectively outputs positive and negative voltages (+Vs/2 and −Vs/2) using a voltage (Vs/2) supplied from a power supply (not shown). A driver circuit 32 applies the power supply voltage (±Vs/2) supplied from the power supply circuit 31 to the load 20. The power supply circuit 31 and driver circuit 32 are connected by a first signal line OUTA and second signal line OUTB. The power supply circuit 31 and driver circuit 32 are connected to the common electrode X side of the load 20.

The power supply circuit 31 has a capacitor C1 and three switches SW1, SW2, and SW3. The two switches SW1 and SW2 are connected in series between the ground (GND) and the power supply line of the voltage (Vs/2) supplied from a power supply (not shown). The interconnection node between the two switches SW1 and SW2 is connected to one terminal of the capacitor C1. The remaining switch SW3 is connected between the GND and the other terminal of the capacitor C1.

The driver circuit 32 has two switches SW4 and SW5. The two switches SW4 and SW5 are connected in series between the terminals of the capacitor C1 in the power supply circuit 31. The electrode X of the load 20 is connected to the interconnection node between the switches SW4 and SW5 through an output line OUTC.

A switch SW6 applies a voltage Vx' (=Vs/2+Vx) to the common electrode X. The switch SW6 is connected in series between the second signal line OUTB and the power supply line of the voltage Vx' supplied from a power supply (not shown). Diodes D4 and D5 are connected in parallel with the switches SW5 and SW4, respectively. The diode D4 flows a current from the GND to the load 20 through the common electrode X at a timing when the positive voltage (+Vs/2) applied to the scanning electrode Y is returned to the ground level. The diode D5 flows a current from the load 20 to the GND through the common electrode X at a timing when the positive voltage (+Vs/2) is applied to the scanning electrode Y.

A power supply circuit 31' and driver circuit 32' include the same arrangements as those of the power supply circuit 31 and driver circuit 32. The power supply circuit 31' and driver circuit 32' are connected by a third signal line OUTA' and fourth signal line OUTB'. The power supply circuit 31' and driver circuit 32' are connected to the scanning electrode Y side of the load 20.

Two switches SW1' and SW2' in the power supply circuit 31' are connected in series between the GND and the power supply line of the voltage (Vs/2) supplied from the power supply (not shown), like the switches SW1 and SW2. The interconnection node between the two switches SW1' and SW2' is connected to one terminal of a capacitor C2. A remaining switch SW3' is connected between the GND and the other terminal of the capacitor C2.

A switch SW4' in the driver circuit 32' is connected between the one terminal of the capacitor C2 and the cathode of a diode D7. The other terminal of the capacitor C2 is connected to the anode of the diode D7. A switch SW5' in the driver circuit 321 is connected between the other terminal of the capacitor C2 and the anode of a diode D6. The one terminal of the capacitor C2 is connected to the cathode of the diode D6.

One terminal of the switch SW4' connected to the cathode of the diode D7 and one terminal of the switch SW5' connected to the anode of the diode D6, which constitute the driver circuit 32', are connected to the load 20 through a scan driver 34. The scan driver 34 has a series circuit of two transistors. The interconnection node between the two transistors is connected to the scanning electrode Y of the load 20 through an output line OUTC'. The scan driver 34 is prepared for each of a plurality of display lines of the PDP.

A ramp wave generation circuit 33 generates a ramp wave in applying a negative voltage to the scanning electrode Y in the full erase period in the reset period. The ramp wave generation circuit 33 has a switch SW10 having a resistor R3 and connected in series between the GND and the third signal line OUTA' side of the capacitor C2, i.e., the high-potential electrode side of the capacitor C2 so as to generate a ramp wave whose voltage continuously changes along with the elapse of time due to the function of the resistor R3.

A switch SW7 applies to the scanning electrode Y a voltage Vw' for writing operation in a cell in the reset period. The switch SW7 is connected in series between a fourth signal line OUTB' and the power supply line of the voltage Vw' supplied from a power supply (not shown). The switch SW7 has an internal resistor such that the applied voltage is continuously changed along with the elapse of time by the function of the resistor, thereby applying the voltage Vw' to the scanning electrode Y.

Switches SW8 and SW9 give a potential difference of (Vs/2) across the scan driver 34 during the address period. During the address period, in outputting a scan pulse to each scanning electrode Y corresponding to a line-sequentially selected display line, the switches SW2', SW8, and SW9 are appropriately controlled to set the voltage on the upper side of the scan driver 34 at the ground level and the voltage on the lower side of the scan driver 34 at the negative voltage −Vy.

Figure 2:
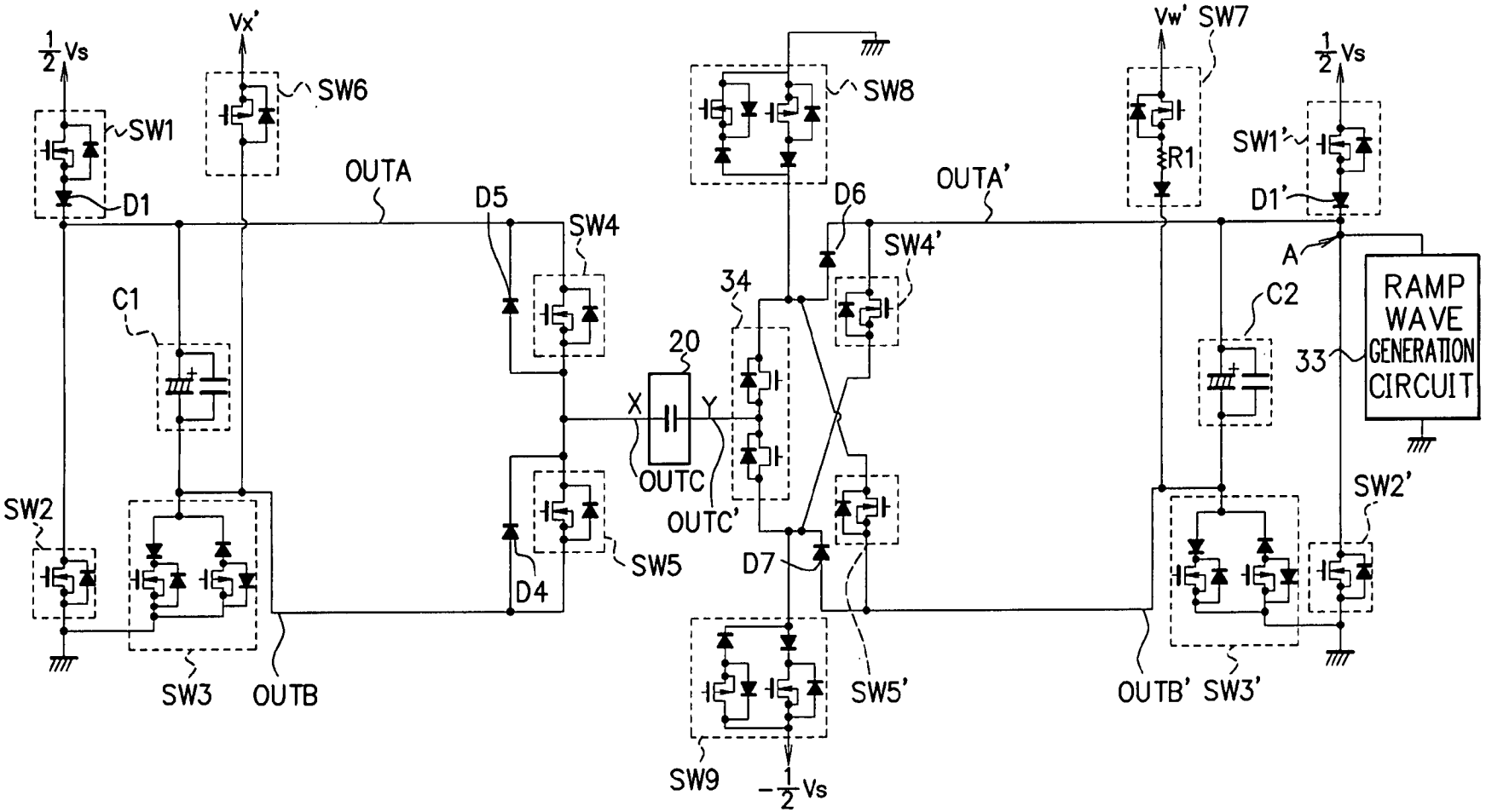
FIG. 2 is a circuit diagram showing the detailed circuit arrangement of the driving circuit according to the first embodiment.

FIG. 2 is a circuit diagram showing the detailed circuit arrangement of the driving circuit according to the first embodiment shown in FIG. 1. Referring to FIG. 2, the same reference numerals as in the driving circuit shown in FIG. 1 denote parts having the same functions as in FIG. 1.

As shown in FIG. 2, the switches SW1 to SW5, SW1' to SW5', and SW6 to SW9 are formed from transistors (MOSFETs (MOS Field Effect Transistors)) and diodes connected to the MOSFETs as needed. Although not illustrated, the switch SW10 in the ramp wave generation circuit 33 also has the same arrangement. Details of the ramp wave generation circuit 33 will be described later.

In the switch SW7, a MOSFET and a resistor RI are connected in series between the power supply line of the voltage Vw' and the fourth signal line OUTB', as described above. In applying the voltage Vw' to the fourth signal line OUTB' by turning on the switch SW7, the voltage is applied such that it is continuously changed along with the elapse of time by the function of the resistor R1.

The ramp wave generation circuit 33 shown in FIGS. 1 and 2 will be described next in detail.

Figure 3:
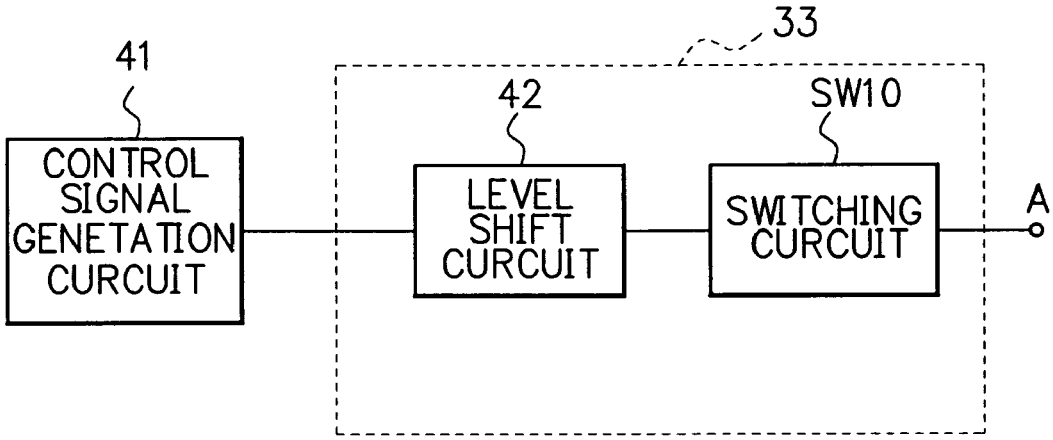
FIG. 3 is a block diagram for explaining the arrangement of a ramp wave generation circuit in the driving circuit according to the first embodiment.

FIG. 3 is a block diagram for explaining the arrangement of the ramp wave generation circuit.

Referring to FIG. 3, a control signal generation circuit 41 generates a control signal for the switch SW10 in the ramp wave generation circuit 33 or control signals for the remaining switches of the driving circuit shown in FIGS. 1 and 2, thereby controlling the switches and applying a voltage to each electrode.

The ramp wave generation circuit 33 comprises a level shift circuit 42 and switch SW10. The level shift circuit 42 level-shifts a control signal for the switch SW10, which is supplied from the control signal generation circuit 41, to the drive level of the switch SW10. The switch SW10 changes the potential at a node A of the third signal line OUTA'. The switch SW10 ON/OFF-controls an internal transistor in accordance with the control signal level-shifted by the level shift circuit 42, thereby changing the potential at the node A.

Figure 4:
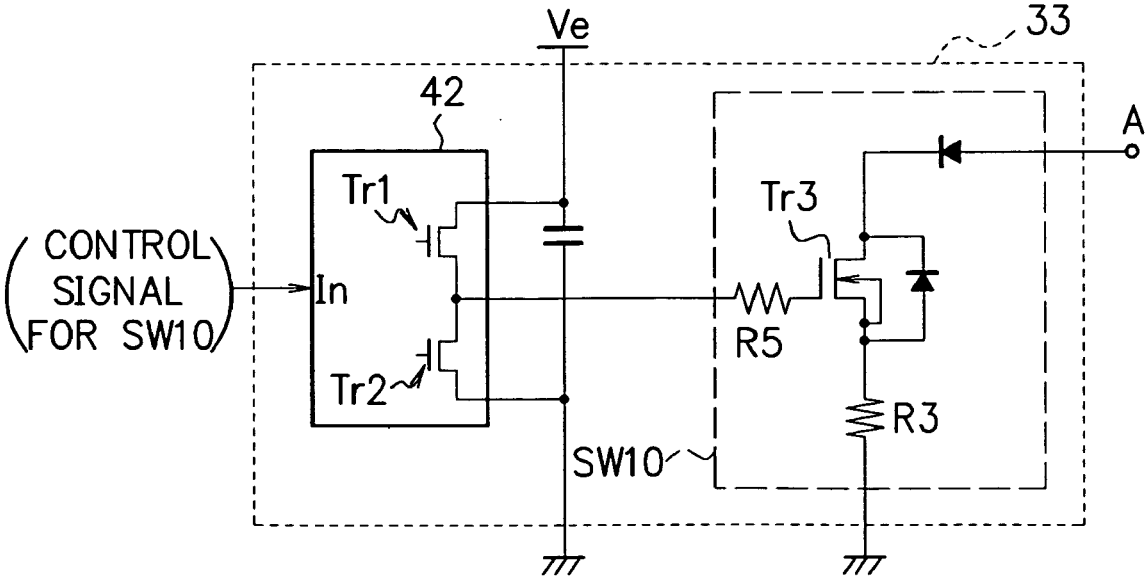
FIG. 4 is a circuit diagram showing the detailed circuit arrangements of a level shift circuit and switch SW10.

FIG. 4 is a circuit diagram showing the detailed circuit arrangements of the level shift circuit 42 and switch SW10 shown in FIG. 3.

Referring to FIG. 4, the level shift circuit 42 is formed from a MOS driver which receives a power supply Ve with reference to the GND level and has two transistors Tr1 and Tr2 connected in series between the supplied power supply Ve and the GND. The switch SW10 is connected to the interconnection node between the two series-connected transistors Tr1 and Tr2 through the output terminal of the level shift circuit 42. The level shift circuit 42 amplifies a received control signal for the switch SW10 by the transistors Tr1 and Tr2 and supplies a drive voltage to the switch SW10.

That is, the level shift circuit 42 ON/OFF-controls the two transistors Tr1 and Tr2 in accordance with the control signal for the switch SW10, which is supplied from the control signal generation circuit 41 (not shown) through an input terminal In, thereby supplying the drive voltage to the switch SW10.

The switch SW10 comprises a transistor Tr3 and resistors R3 and R5. The gate of the transistor Tr3 is connected, through the resistor R5, to the output terminal of the level shift circuit (MOS driver) 42, i.e., the interconnection node between the two transistors Tr1 and Tr2. The drain of the transistor Tr3 is connected to the node A on the third signal line OUTA' through a diode, and the source of the transistor Tr3 is connected to one terminal of the resistor R3. The other terminal of the resistor R3 is connected to the GND. That is, the transistor Tr3 and resistor R3 in the switch SW10 are connected in series between the third signal line OUTA' and the GND.

As the transistor Tr3 and resistor R3 are connected in this way, when the transistor Tr3 changes from the OFF state to the ON state, the potential of the node A is set at GND (0 V). At this time, by the function of the resistor R3 connected in series with the transistor Tr3, the potential of the node A continuously changes to the GND along with the elapse of time.

Additionally, in the switch SW10, when the resistance value of at least one of the resistors arranged in the gate-charge loop, i.e., the resistor R5 connected to the gate of the transistor Tr3 and the resistor R3 connected to the source of the transistor Tr3, is changed, the potential change rate with respect to time from when the transistor Tr3 has changed from the OFF state to the ON state until the potential of the node A changes to the GND can be changed.

Figure 5:
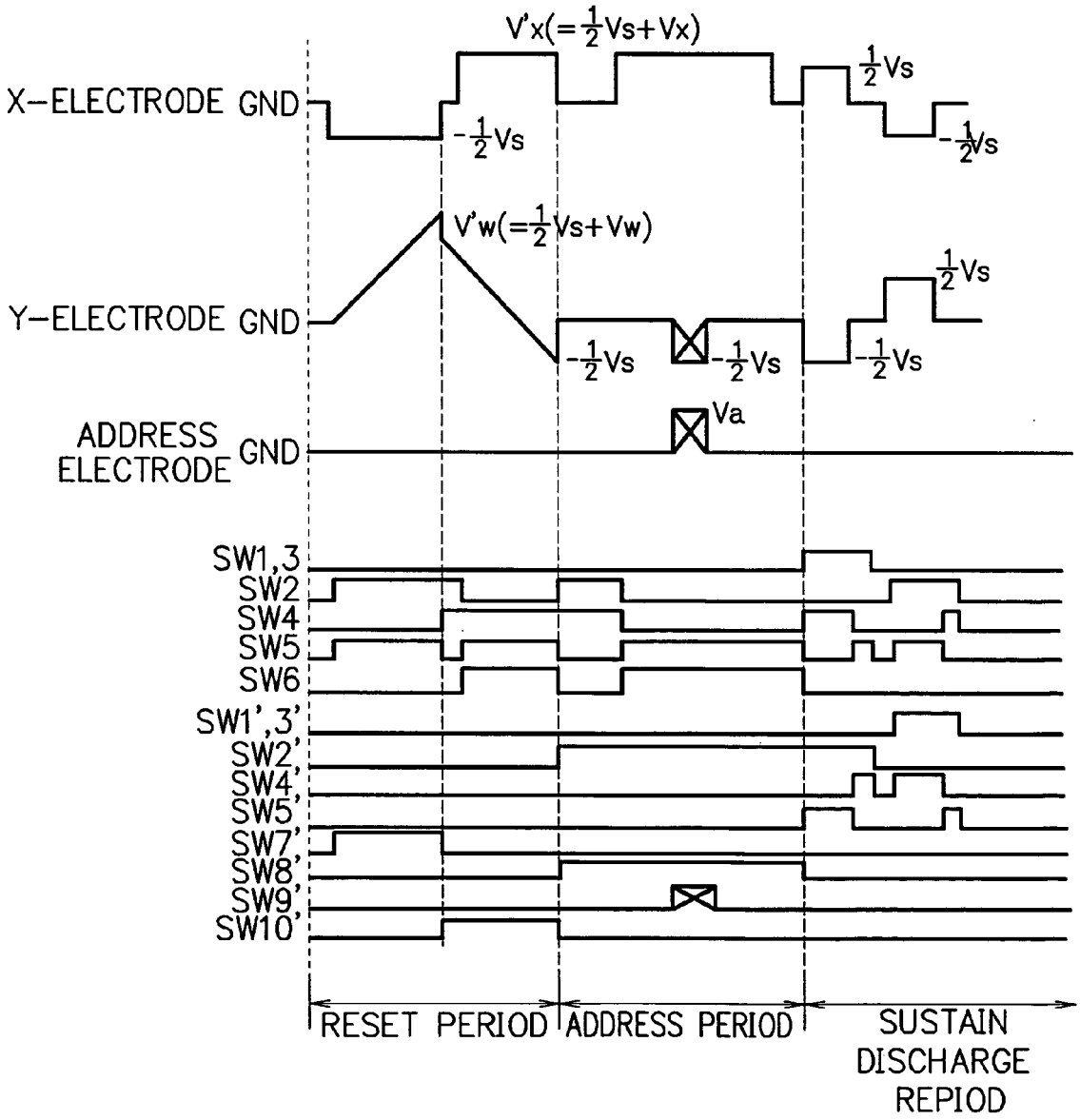
FIG. 5 is a timing chart showing the drive waveforms of the driving circuit according to the first embodiment.

FIG. 5 is a timing chart showing the drive waveforms of the driving circuit according to the first embodiment. FIG. 5 shows one of a plurality of subfields of one frame. For the description of FIG. 5, assume that charges corresponding to the voltage (Vs/2) are accumulated in the capacitor C1 on the common electrode X side and in the capacitor C2 on the scanning electrode Y side by processing of the preceding subfield.

Figure 18:
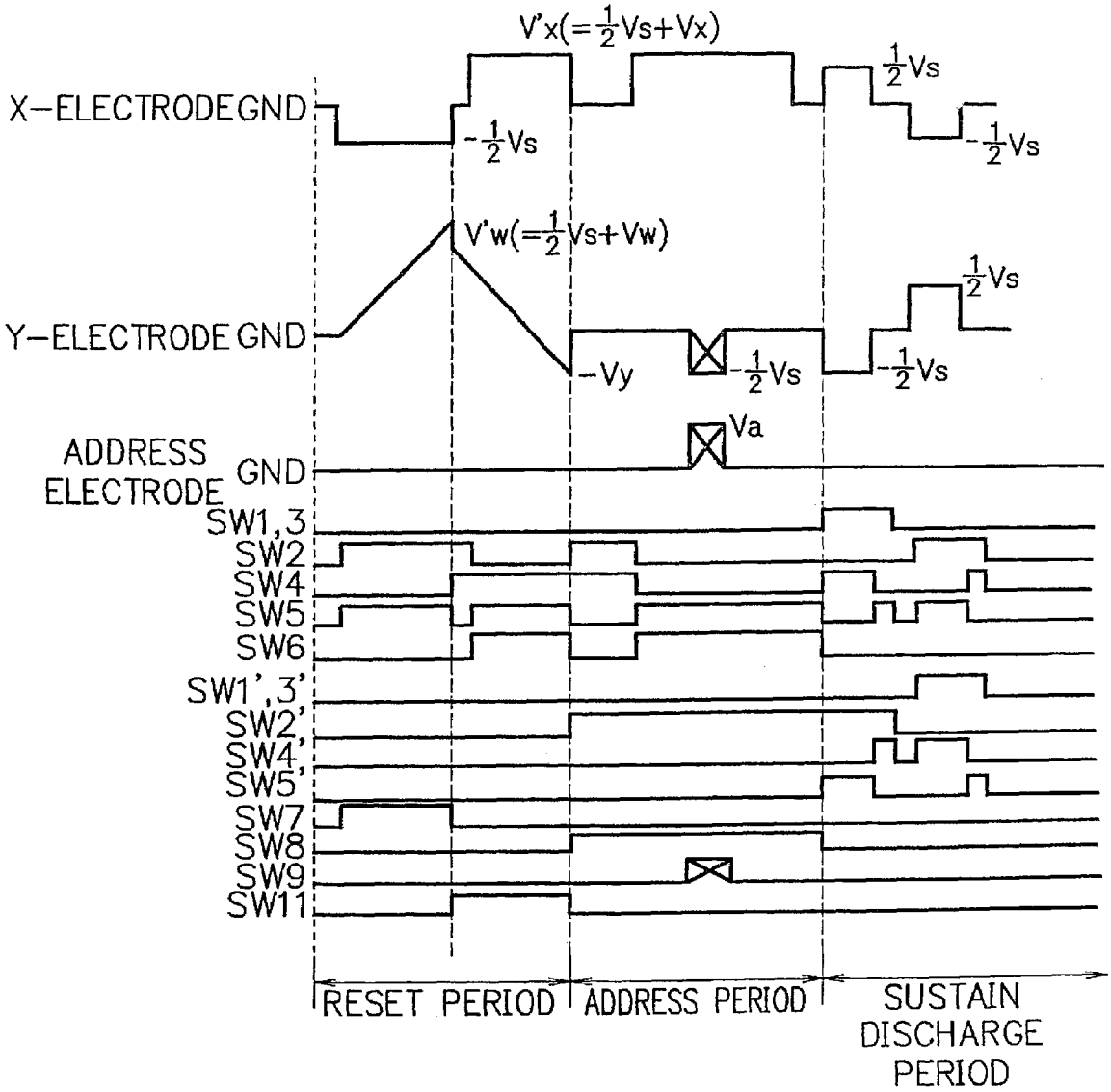
FIG. 18 PRIOR ART
FIG. 18 is a timing chart showing an AC-driven PDP diving method.

Control of the switches SW1 to SW6 on the common electrode X side is the same as in FIG. 18 described above, and a description thereof will be omitted. Control of the switches SW1' to SW5' and SW7 to SW10 on the scanning electrode Y side will be described below.

In the reset period, first, the negative voltage (−Vs/2) is applied to the common electrode X. Simultaneously, on the scanning electrode Y side, the switch SW7 is turned on, and the switches SW1' to SW5' and SW8 to SW10 are turned off to apply to all scanning electrodes Y a ramp wave that continuously changes along with the elapse of time and finally reaches the positive voltage Vw' (=Vs/2+Vw).

In applying the ramp wave, discharge sequentially occurs in cells where the potential difference between the voltage of the Y-electrode and that of the common electrode X has reached the discharge start voltage during the rise of the ramp wave, so that each cell can perform discharge at an optimum voltage (voltage almost equal to the discharge start voltage).

Next, the voltage applied to the scanning electrode Y changes to the voltage Vw'. That is, when the potential difference between the common electrode X and the scanning electrode Y changes to a potential difference corresponding to the full write pulse voltage (Vs+Vw), the voltage of the common electrode X is set at the ground level (0 V), and then, the positive voltage (Vs/2) is applied to the common electrode X.

On the scanning electrode Y side, the switch SW7 is turned off, and the switch SW10 is turned on. The ramp wave generation circuit 33 decreases the potential of the third signal line OUTA' to the GND through the node A. At this time, the potential of the third signal line OUTA' gradually drops to the GND due to the function of the resistor R3 in the ramp wave generation circuit 33.

When the potential of the third signal line OUTA' drops to the GND, the potential of the fourth signal line OUTB' connected to the other terminal of the capacitor C2 drops to (−Vs/2). With this operation, the potential of the scanning electrode Y is finally reduced to the negative voltage (−Vs/2).

As described above, when a ramp wave that finally reaches the negative voltage (−Vs/2) is applied to the scanning electrode Y, the voltage of wall charges themselves exceeds the discharge start voltage in all cells, and discharge starts. At this time, weak discharge occurs between the common electrode X and the scanning electrode Y, and accumulated wall charges are erased with some exceptions.

In the address period, address discharge is line-sequentially performed to turn on/off each cell in accordance with display data. At this time, the voltage (Vs/2+Vx) is applied to the common electrode X. For the scanning electrodes Y, the switches SW2', SW8, and SW9 are turned on to apply the voltage (−Vs/2) to each scanning electrode Y corresponding to a line-sequentially selected display line. In addition, the switches SW2' and SW8 are turned on and the switch SW9 is turned off to set each unselected scanning electrode Y at GND.

An address pulse having the voltage Va is selectively applied to an address electrode Aj in the address electrodes A1 to Am, which corresponds to a cell which should cause sustain discharge, i.e., a cell to be turned on in the sustain discharge period. As a result, discharge occurs between the address electrode Aj of the cell to be turned on and the line-sequentially selected scanning electrode Y. With this priming (pilot flame), discharge between the common electrode X and the scanning electrode Y immediately starts. Wall charges in an amount enough for the next sustain discharge are accumulated on the MgO protective film on the common electrode X and scanning electrode Y of the selected cell.

When a ramp wave with a gradually dropping applied voltage is applied in the full erase period in the reset period to perform weak discharge, wall charges on the scanning electrode Y are not completely erased and some wall charges can be left. For this reason, when the potential difference between the address electrode Aj and the scanning electrode Y becomes (Va+Vs/2), the discharge start voltage can be obtained by the residual wall charges and the actually applied voltage, and discharge starts between the address electrode Aj and the scanning electrode Y.

In the sustain discharge period, when the switches SW1 to SW5 and SW1' to SW5' are controlled at appropriate timings, as shown in FIG. 5, the voltage (±Vs/2) is applied to the common electrode X and the scanning electrode Y of the display line such that their phases are inverted. That is, when the positive voltage (+Vs/2) is applied to the common electrode X, the negative voltage (−Vs/2) is applied to the scanning electrode Y. With this operation, the potential difference between the common electrode X and the scanning electrode Y can be changed to a voltage that enables discharge between them. Hence, sustain discharge occurs, and an image of one subfield is displayed. During the sustain discharge period, the potentials of the address electrodes A1 to Am are maintained at GND as the intermediate potential between the common electrode X and the scanning electrode Y.

Figure 17:
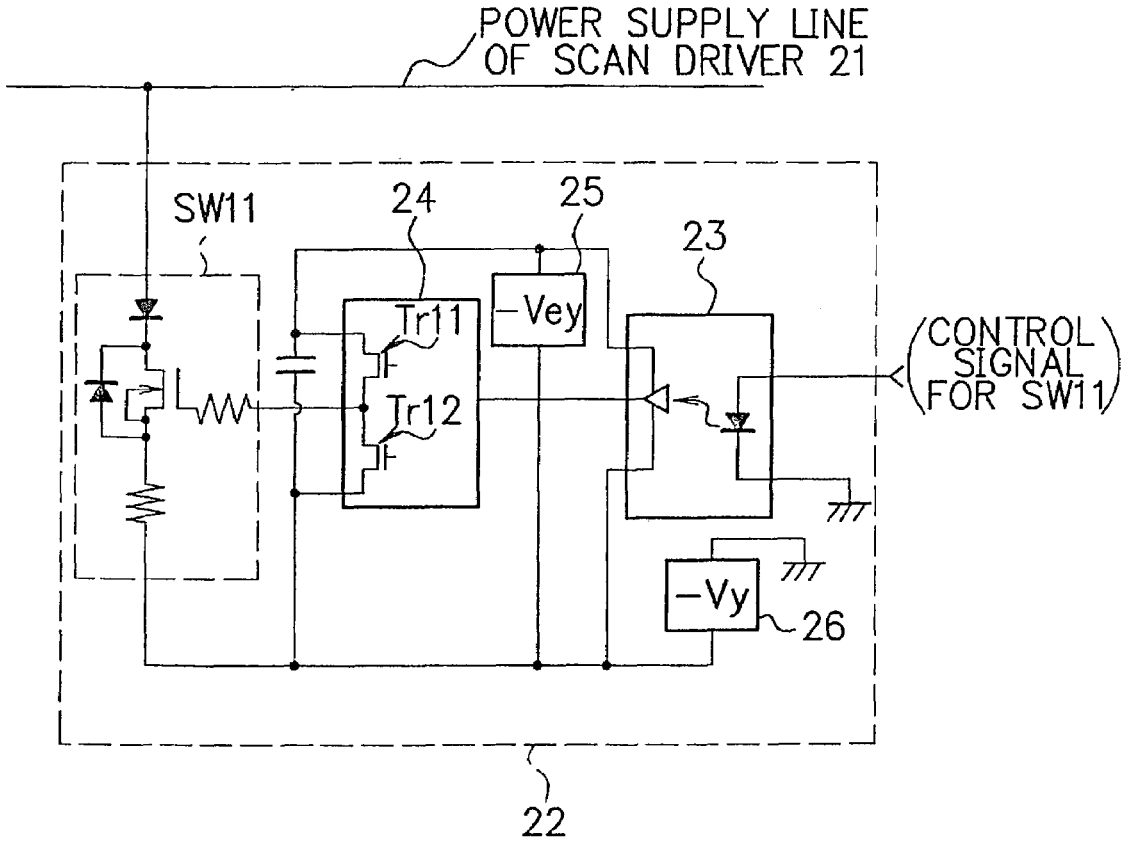
F I G. 17 PRIOR ART
FIG. 17 is a circuit diagram showing the detailed circuit arrangement of a ramp wave generation circuit.

As described above in detail, according to this embodiment, since the ramp wave generation circuit 33 having the switch SW10 including the resistor R3 is connected between the GND and the anode side of the capacitor C2, i.e., the third signal line OUTA', the reference potential of each element of the ramp wave generation circuit 33 can be set at the GND potential. Hence, the ramp wave generation circuit 33 can be operated using the power supply for supplying the voltage Vs/2 used by the remaining elements of the driving circuit without newly arranging the plurality of power supplies 25 and 26, as shown in FIG. 17.

The reference potential of the resistor R3 in the switch SW10 is also the GND potential. For this reason, without converting the level of an externally supplied control signal using an isolation component such as the photocoupler 23 shown in FIG. 17, the supplied control signal with the reference level (GND reference) can be directly supplied to the transistor Tr3 to control the switch SW10.

Hence, without using a plurality of power supplies or a circuit (isolation component) for converting the reference level of a control signal, a ramp waveform that continuously changes from the positive voltage Vw' to the negative voltage (−Vs/2) along with the elapse of time can be applied to the scanning electrode Y in the full erase period in the reset period with a simple circuit arrangement.

Figure 6:
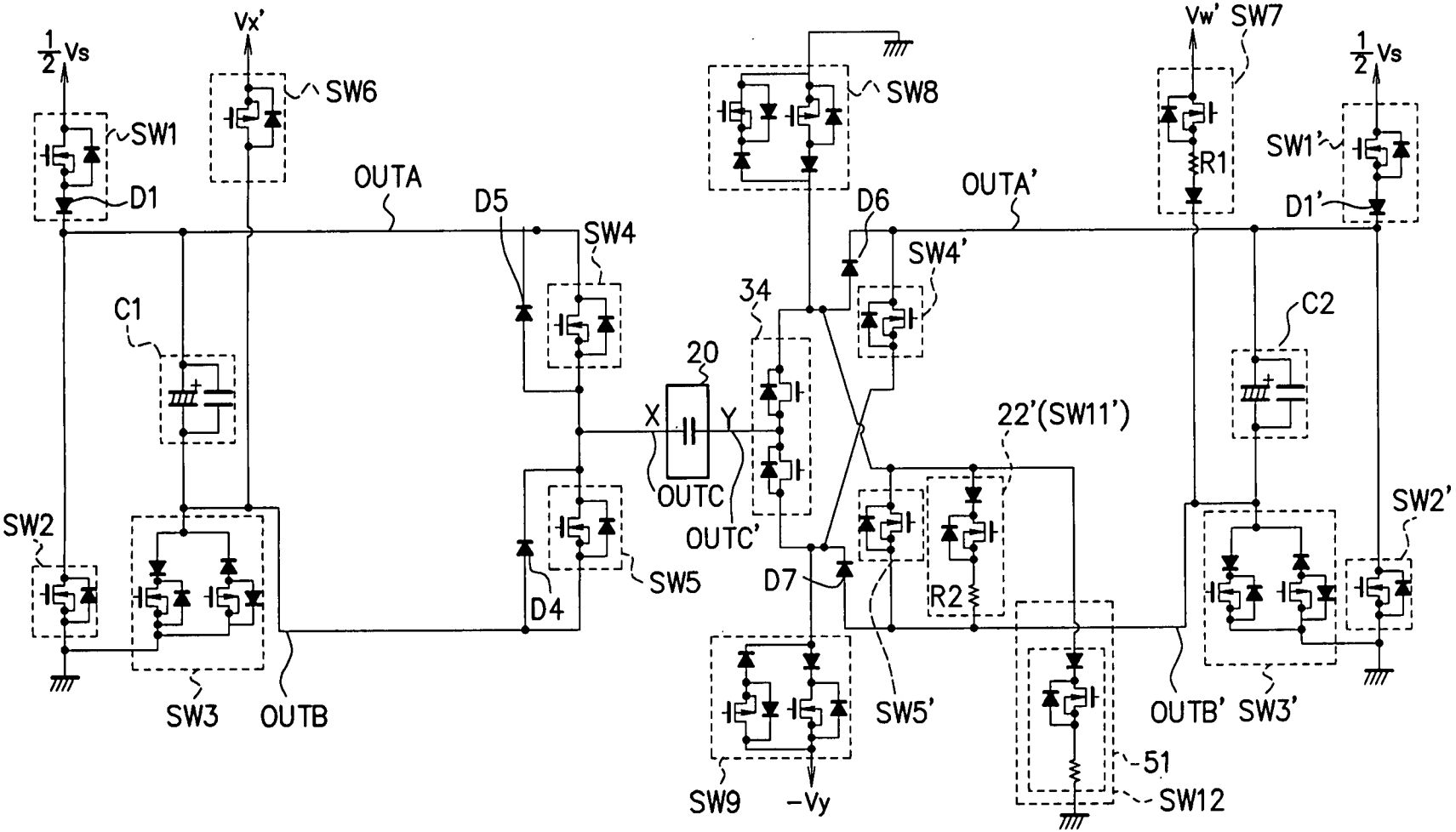
FIG. 6 is a circuit diagram showing the circuit arrangement of a driving circuit to be compared with the driving circuit according to the first embodiment.

As a driving method of changing the voltage applied to the scanning electrode Y from the positive voltage Vw' to the negative voltage (−Vs/2) in the full erase period in the reset period, a ramp wave may be applied using a driving circuit shown in FIG. 6 such that the potential of the scanning electrode Y is changed to the ground level and then to the negative voltage (−Vs/2).

FIG. 6 is a circuit diagram showing the circuit arrangement of a driving circuit to be compared with the driving circuit according to the first embodiment.

Figure 16:
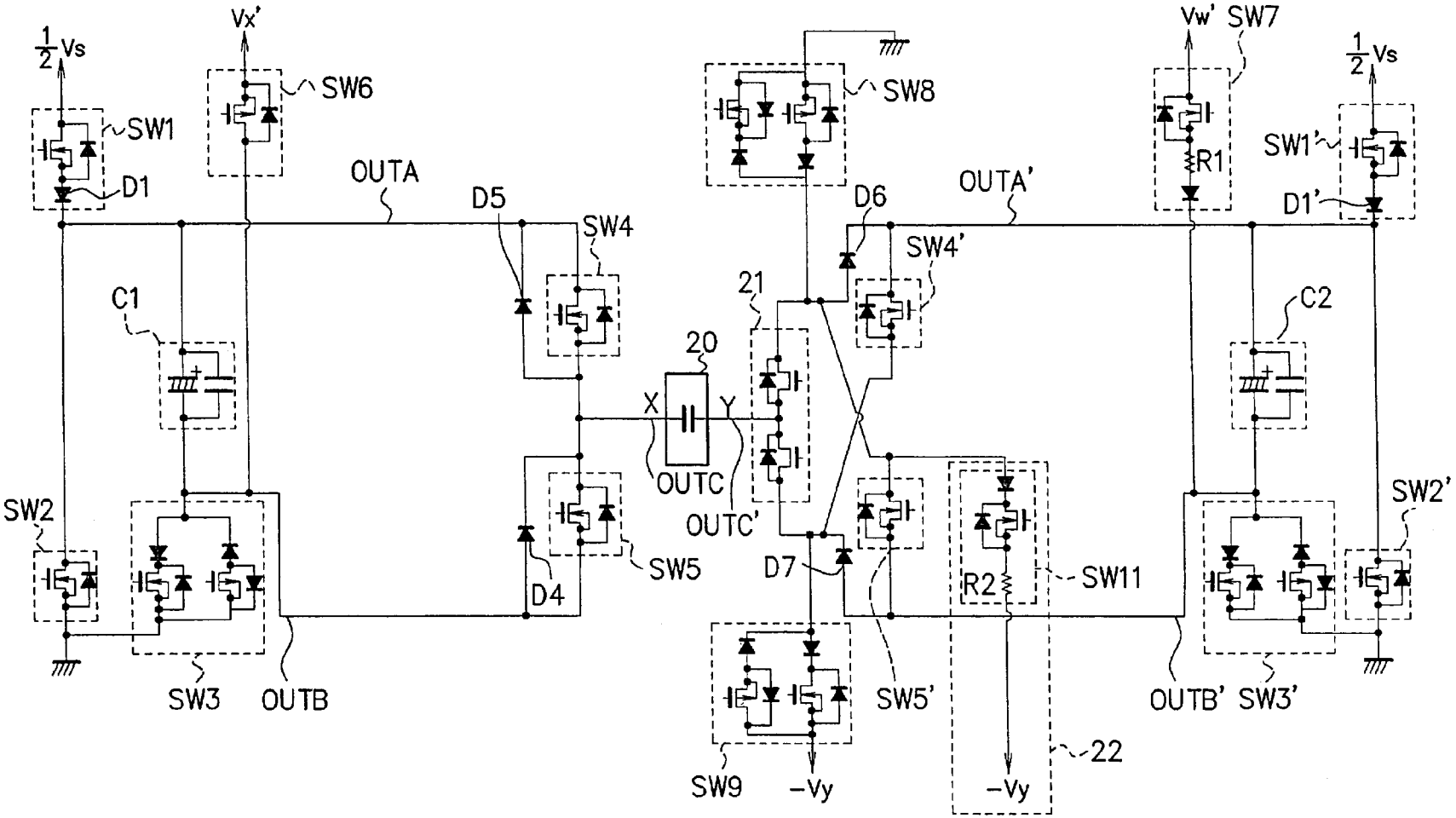
FIG. 16 PRIOR ART
FIG. 16 is a circuit diagram showing the circuit arrangement of an AC-driven PDP driving circuit.

Referring to FIG. 6, the same reference numerals as in FIGS. 2 and 16 denote parts having the same functions as in FIGS. 2 and 16, and a repetitive description will be omitted.

In the arrangement shown in FIG. 16, a ramp wave for changing the voltage applied to the scanning electrode Y from the positive voltage Vw' to the negative voltage (−Vs/2) is generated by the single ramp wave generation circuit 22. In the driving circuit shown in FIG. 6, however, the ramp wave for changing the positive voltage Vw' to the negative voltage (−Vs/2) is generated by two ramp wave generation circuits 22' and 51.

Referring to FIG. 6, the ramp wave generation circuit 22' generates a ramp wave for changing the voltage applied to the scanning electrode Y from the positive voltage Vw' to the ground level (0 V). The ramp wave generation circuit 22' comprises a switch SW11'. The switch SW11' is connected in series between the GND and the power supply line of the scan driver 34.

The ramp wave generation circuit 51 generates a ramp wave for changing the voltage applied to the scanning electrode Y from the ground level (0 V) to the negative voltage (−Vs/2). The ramp wave generation circuit 51 comprises a switch SW12. The switch SW12 is connected in series between the fourth signal line OUTB' and the power supply line of the scan driver 34.

That is, in the driving circuit shown in FIG. 6, first, the voltage of the scanning electrode Y is changed from the positive voltage Vw' to the ground level by the ramp wave generation circuit 22', and then, the voltage of the scanning electrode Y is changed from the ground level to the negative voltage (−Vs/2) by the ramp wave generation circuit 51.

Figure 7:
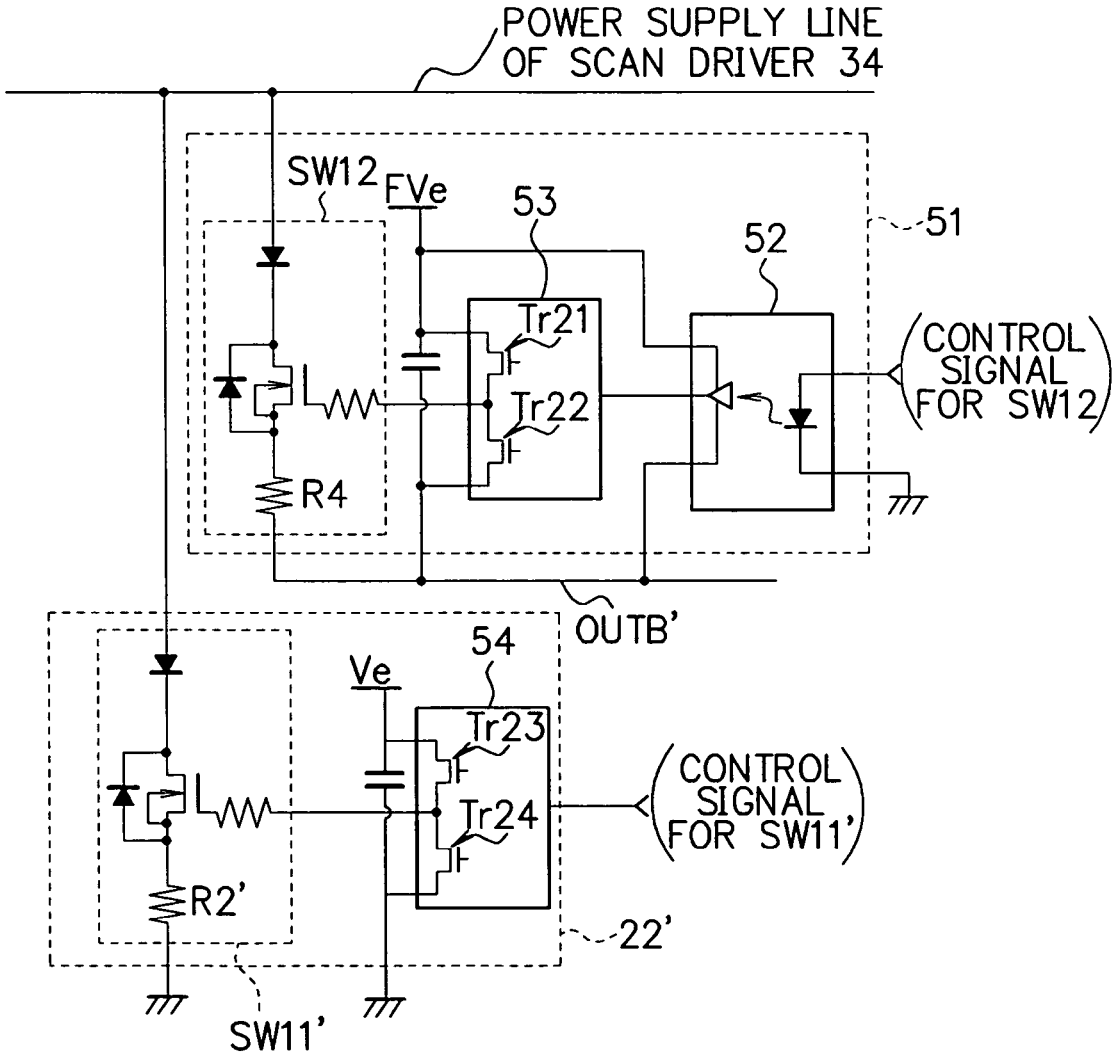
FIG. 7 is a circuit diagram showing the detailed circuit arrangement of a ramp wave generation circuit.

FIG. 7 is a circuit diagram showing the detailed circuit arrangements of the ramp wave generation circuits 22' and 51 shown in FIG. 6. Referring to FIG. 7, the same reference numerals as in the driving circuit shown in FIG. 6 denote parts having the same functions as in FIG. 6.

Referring to FIG. 7, the ramp wave generation circuit 51 comprises a photocoupler 52, MOS driver 53, and switch SW12. The photocoupler 52 converts the reference level of a control signal for the switch SW12, which is supplied from a drive signal generation circuit (not shown), from the ground level to the potential level of the fourth signal line OUTB'. This level conversion is done because the source of the transistor in the switch SW12 is connected to the fourth signal line OUTB', and that transistor operates with reference to the potential of the fourth signal line OUTB'.

The MOS driver 53 level-shifts the control signal for the switch SW12, which is level-converted by the photocoupler 52, to the gate drive level of the switch SW12 and supplies the control signal to the switch SW12. The MOS driver 53 comprises two transistors Tr21 and Tr22. The transistors Tr21 and Tr22 are ON/OFF-controlled in accordance with the control signal for the switch SW12, which is level-converted by the photocoupler 52, thereby supplying the control signal for the switch SW12 to the switch SW12.

The switch SW12 comprises a transistor and a resistor R4 connected in series between the fourth signal line OUTB' and the power supply line of the scan driver. The drain of the transistor is connected to the power supply line of the scan driver through a diode, and its source is connected to the fourth signal line OUTB' through the resistor R4. The gate of this transistor is connected to the output terminal of the MOS driver 53 so as to receive the drive voltage for the switch SW12, which is level-shifted by the MOS driver.

The ramp wave generation circuit 22' comprises a MOS driver 54 for driving and a switch SW11'. In the ramp wave generation circuit 22', since the source of the transistor in the switch SW11' is connected to the ground, and the transistor operates with reference to the ground, no level conversion circuit such as a photocoupler is required.

The MOS driver 54 level-shifts a control signal for the switch SW11' with reference to the ground level, which is supplied from a drive signal generation circuit (not shown), to the gate drive level of the switch SW11' and supplies the control signal to the switch SW11'. The MOS driver 54 has two transistors Tr23 and Tr24, like the above MOS driver.

The switch SW11' comprises a transistor and a resistor R2' connected in series between the GND and the power supply line of the scan driver. The drain of the transistor is connected to the power supply line of the scan driver through a diode, and its source is connected to the GND through the resistor R2'. The gate of this transistor is connected to the output terminal of the MOS driver 54 so as to receive the drive voltage for the switch SW11', which is level-shifted by the MOS driver 54.

Figure 8:
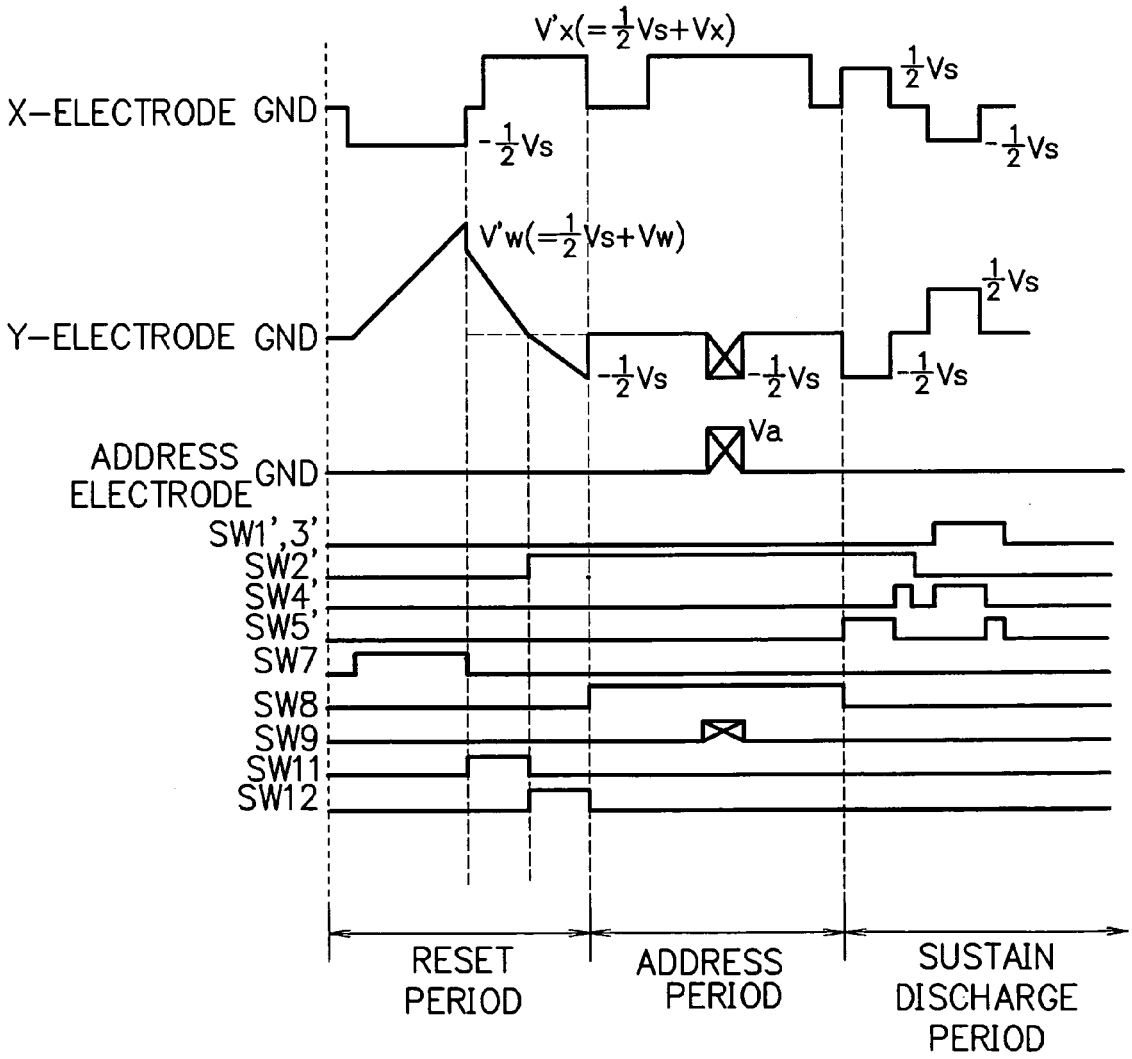
FIG. 8 is a timing chart of the drive waveforms of the driving circuit shown in FIG. 6.

FIG. 8 is a timing chart of the drive waveforms of the driving circuit shown in FIGS. 6 and 7. FIG. 8 shows one of a plurality of subfields of one frame. For the description of FIG. 8, assume that charges corresponding to the voltage (Vs/2) are accumulated in the capacitor C1 on the common electrode X side and in the capacitor C2 on the scanning electrode Y side by processing of the preceding subfield.

Control of the switches SW1 to SW6 on the common electrode X side is the same as in FIG. 18 described above, and a description thereof will be omitted.

In the reset period, first, the negative voltage (−Vs/2) is applied to the common electrode X. Simultaneously, on the scanning electrode Y side, the switch SW7 is turned on, and the switches SW1' to SW5' SW8, SW9, SW11', and SW12 are turned off to apply the positive voltage Vw' (=Vs/2+Vw) to all scanning electrodes Y. The positive voltage (Vs/2+Vw) applied to the scanning electrode Y continuously changes along with the elapse of time due to the function of the resistor R1.

Next, the voltage of the common electrode X is set at the ground level (0 V), and then, the positive voltage (Vs/2) is applied to the common electrode X. For the scanning electrode Y, a ramp wave whose voltage gradually drops and finally reaches the negative voltage (−Vs/2) is applied to the scanning electrode Y. As the ramp wave applied to the scanning electrode Y, first, the switch SW7 is turned off, and the switch SW11' in the ramp wave generation circuit 22' is turned on, thereby applying a ramp wave for setting the scanning electrode Y at the ground level. After the voltage of the scanning electrode Y is set at the ground level, the switch SW11' is turned off, and the switch SW2' and the switch SW12 in the ramp wave generation circuit 51 are turned on, thereby applying a ramp wave for changing the voltage applied to the scanning electrode Y to the negative voltage (−Vs/2).

With this operation, the voltage of wall charges themselves exceeds the discharge start voltage in all cells, and discharge starts. At this time as well, weak discharge occurs in accordance with the application of the ramp wave, and accumulated wall charges are erased with some exceptions.

In the address period and sustain discharge period, the same control as in the driving circuit according to the above-described first embodiment is performed, thereby applying the voltages shown in FIG. 8 to the respective electrodes.

As described above, when the ramp wave generation circuit 22' for applying to the scanning electrode Y a ramp wave that changes from the positive voltage Vw' to the GND and the ramp wave generation circuit 51 for applying a ramp wave that changes from the GND to the negative voltage (−Vs/2) are arranged, the potential of the scanning electrode Y can be changed from the positive voltage Vw' to the negative voltage (−Vs/2) along with the elapse of time without preparing a new power supply.

However, as shown in FIG. 8, to change the potential of the scanning electrode Y from the positive voltage Vw' to the negative voltage (−Vs/2), the switches SW2', SW11', and SW12 must be controlled altogether, and switch control is complex. That is, to change the potential of the scanning electrode Y first from the positive voltage Vw' to the GND, the switch SW11 in the ramp wave generation circuit 22' is turned on to set the potential of the scanning electrode Y at the GND. After that, the switch SW11 is turned off, the switch SW12 in the ramp wave generation circuit 51 is turned on, and the switch SW2' is turned on.

To the contrary, according to the driving circuit according to the above-described first embodiment shown in FIGS. 1 to 3, in changing the potential of the scanning electrode Y from the positive voltage Vw' to the negative voltage (−Vs/2), the potential of the scanning electrode Y can easily be changed from the positive voltage Vw' to the negative voltage (−Vs/2) by turning on only the switch SW10 in the ramp wave generation circuit 33, as shown in the timing chart of FIG. 5. That is, only by turning on one switch, a ramp wave for changing the potential of the scanning electrode Y from the positive voltage Vw' to the negative voltage (−Vs/2) can be applied to the scanning electrode Y.

In the above-described first embodiment, the switch SW10 formed by connecting the diode, transistor Tr3, and resistor R3 in series in this order between the node A on the third signal line OUTA' as shown in FIG. 4 and the GND is used. However, the arrangement of the switch SW10 is not limited to that shown in FIG. 4, and the switch SW10 can be formed using various circuits.

FIGS. 9A to 9D are circuit diagrams showing other circuit arrangements of the switch SW10.

Figure 9A:
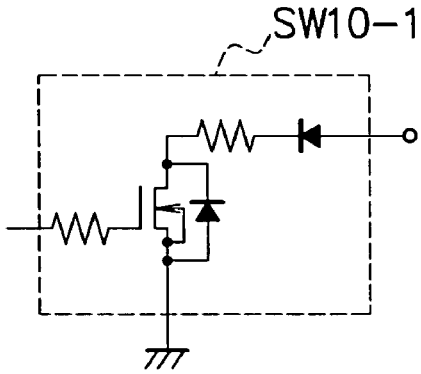
FIGS. 9A to 9D are circuit diagrams showing other circuit arrangements of the switch SW10.

Referring to FIG. 9A, a switch SW10-1 is formed by connecting a diode, resistor, and transistor in series in this order between the node A on the third signal line OUTA' and the GND, unlike the switch shown in FIG. 4 in which the diode, transistor, and resistor are connected in series in this order. Even when the connection order of the transistor and resistor connected in series in the switch is reversed, the ramp wave shown in FIG. 5 described above, which changes the applied voltage from the positive voltage Vw' to the negative voltage (−Vs/2), can be applied to the scanning electrode Y.

A resistor is connected to the gate of the transistor. This resistor corresponds to the resistor R5 shown in FIG. 4 described above. Hence, when the resistance value of the resistor connected to the gate of the transistor is changed, the potential change rate with respect to time from when the transistor has changed from the OFF state to the ON state until the potential of the node A changes to the GND can be changed.

Figure 9B:
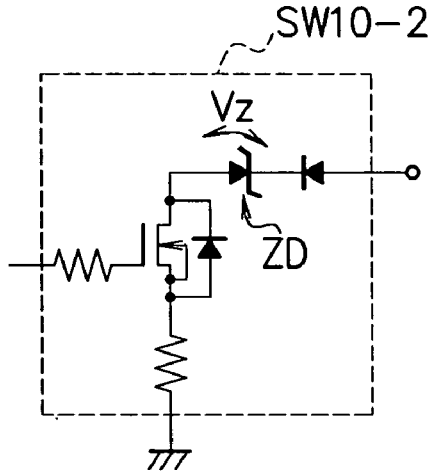
Figure 10:
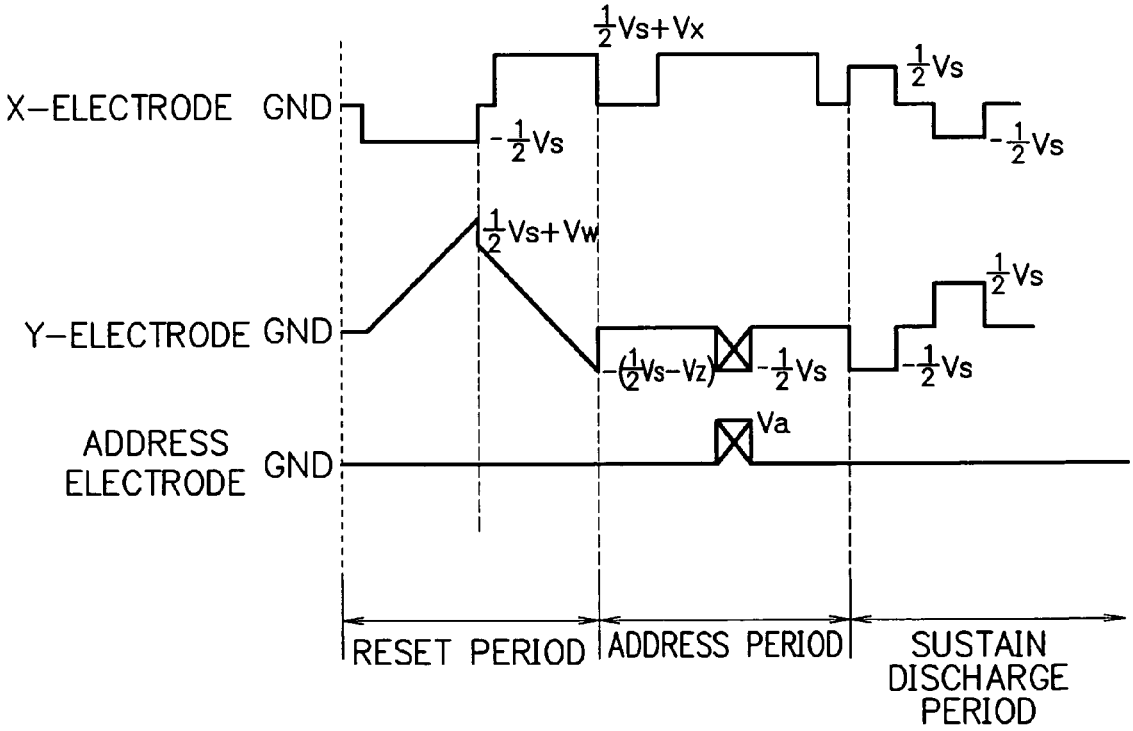
FIG. 10 is a timing chart showing the drive waveforms of the driving circuit according to the first embodiment.

Referring to FIG. 9B, a switch SW10-2 is formed by additionally connecting a Zener diode ZD between the diode and the transistor in the switch SW10 in which the diode, transistor, and resistor are connected in series in this order between the node A on the third signal line OUTA' and the GND. When the Zener diode ZD is connected between the diode and the transistor, the final potential of the applied ramp wave can be set at an arbitrary potential (−Vs/2+Vz) equal to or more than (−Vs/2), as shown in the timing chart of drive waveforms shown in FIG. 10. That is, the voltage applied in the full erase period in the reset period can be offset. With this arrangement, in the address period when a cell to be turned on in the sustain discharge period is to be selected, a cell can be more stably selected (addressed). For example, when the voltage applied in the full erase period is offset in accordance with an error (manufacturing variation) in the manufacturing process of plasma display panels, a cell to be turned on can be more reliably selected.

A resistor is connected to the gate of the transistor. This resistor corresponds to the resistor R5 shown in FIG. 4 described above. The resistor connected between the GND and the source of the transistor corresponds to the resistor R3 shown in FIG. 4 described above. Hence, when the resistance value of at least one of the resistors connected to the gate and source of the transistor is changed, the potential change rate with respect to the time from when the transistor has changed from the OFF state to the ON state until the potential of the node A changes to the GND can be changed.

Figure 9C:
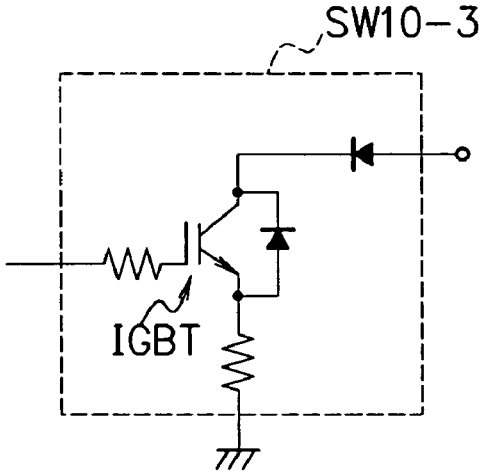

Referring to FIG. 9C, a switch SW10-3 is formed by replacing the transistor (MOSFET) in the switch SW10 in which the diode, transistor, and resistor are connected in series in this order between the node A on the third signal line OUTA' and the GND with an IGBT (Insulated Gate Bipolar Transistor) element. This IGBT element is a bipolar-MOS composite element having three terminals. Since the operating resistance of the IGBT element is smaller than that of a MOSFET, the power loss can be small.

A resistor is connected to the gate of the IGBT. This resistor corresponds to the resistor R5 shown in FIG. 4 described above. The resistor connected between the GND and the source of the IGBT corresponds to the resistor R3 shown in FIG. 4 described above. Hence, when the resistance value of at least one of the resistors connected to the gate and source of the IGBT is changed, the potential change rate with respect to the time from when the IGBT has changed from the OFF state to the ON state until the potential of the node A changes to the GND can be changed.

Figure 9D:
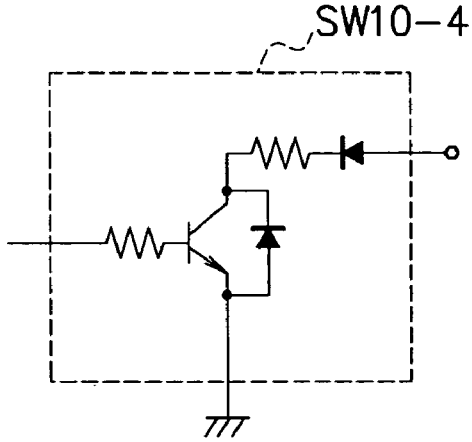

Referring to FIG. 9D, a switch SW10-4 is formed by replacing the transistor (MOSFET) in the switch SW10 in which the diode, transistor, and resistor are connected in series in this order between the node A on the third signal line OUTA' and the GND with a bipolar transistor and connecting the diode, resistor, and bipolar transistor in series in this order between the node A on the third signal line OUTA' and the GND.

A resistor is connected to the base of the bipolar transistor. This resistor corresponds to the resistor R5 shown in FIG. 4 described above. Hence, when the resistance value of the resistor connected to the base of the bipolar transistor is changed, the potential change rate with respect to time from when the bipolar transistor has changed from the OFF state to the ON state until the potential of the node A changes to the GND can be changed.

(Second Embodiment)

The second embodiment of the present invention will be described next.

Figure 11:
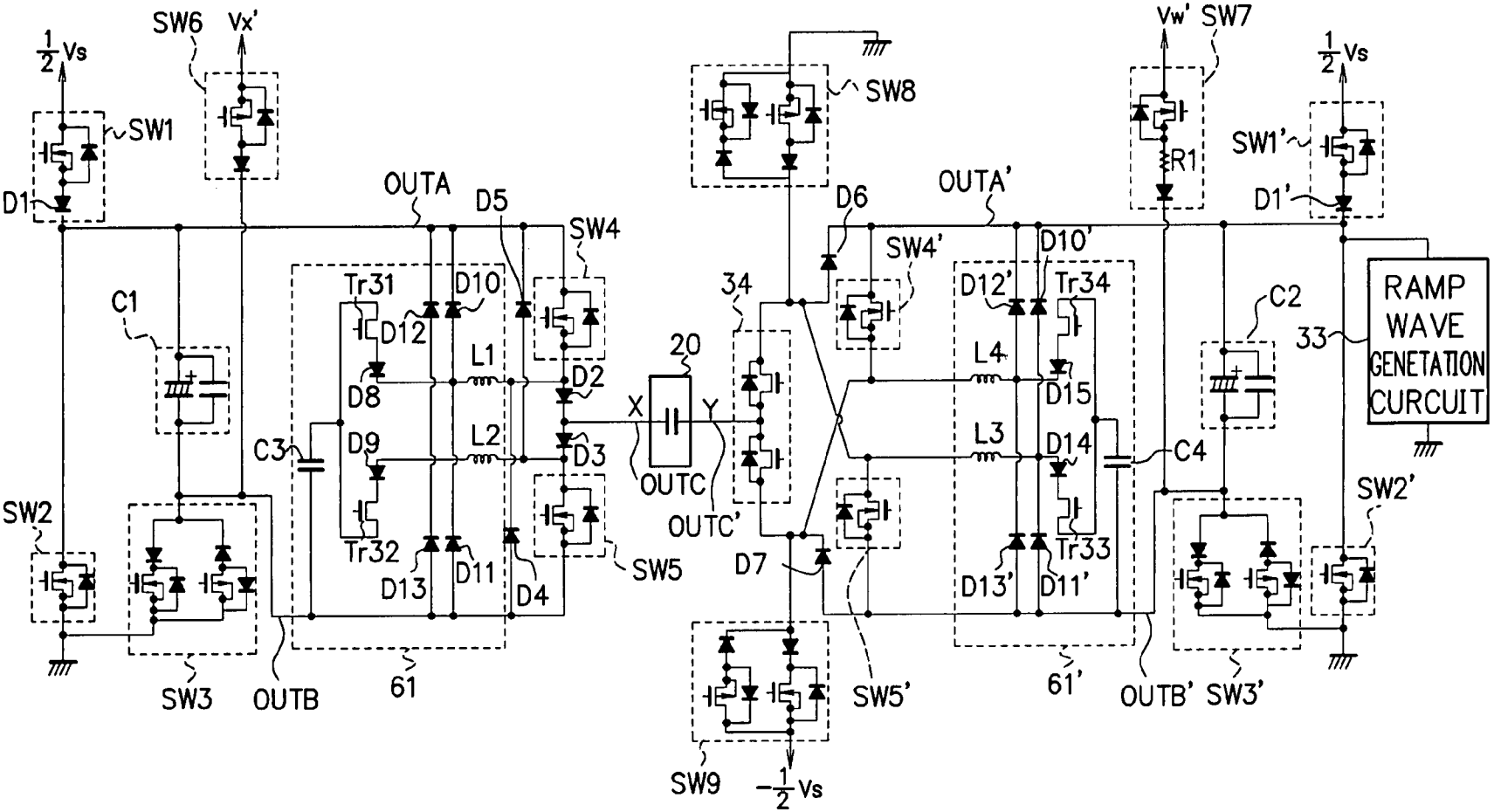
FIG. 11 is a circuit diagram showing the circuit arrangement of an AC-driven PDP driving circuit according to the second embodiment.

FIG. 11 is a circuit diagram showing the circuit arrangement of a driving circuit according to the second embodiment. Referring to FIG. 11, the same reference numerals as in FIG. 2 denote parts having the same functions as in the driving circuit shown in FIG. 2, and a repetitive description will be omitted.

The driving circuit shown in FIG. 11 is constructed by arranging, on the sides of a common electrode X and scanning electrode Y of the driving circuit according to the first embodiment shown in FIG. 2, power recovery circuits 61 and 61' for recovering a power supplied to a load 20. The power recovery circuits 61 and 61' have identical arrangements. The power recovery circuit 61 will be described below.

The power recovery circuit 61 has two coils L1 and L2. The coils L1 and L2 and the common electrode X (output line OUTC) are separated by diodes D2 and D3. A capacitor C3 accumulates recovered charges.

The power recovery circuit 61 has four diodes D10 to D13 as clamp diodes. The diodes D10 and D11 are connected in series between a first signal line OUTA and a second signal line OUTB. The intermediate node between the diodes D10 and D11 is connected between the coil L1 and the cathode of a diode D8. The diodes D12 and D13 are connected in series between the first signal line OUTA and the second signal line OUTB. The intermediate node between the diodes D12 and D13 is connected between the coil L2 and the anode of a diode D9.

When the power recovery circuit 61 has the above arrangement, the capacitive load 20 and the two coils L1 and L2 connected through the two diodes D2 and D3 construct two resonance circuits. That is, the power recovery circuit 61 has two L-C resonance circuits so that charges supplied to the panel by resonance between the coil L1 and the capacitive load 20 are recovered by resonance between the coil L2 and the capacitive load 20.

Figure 12:
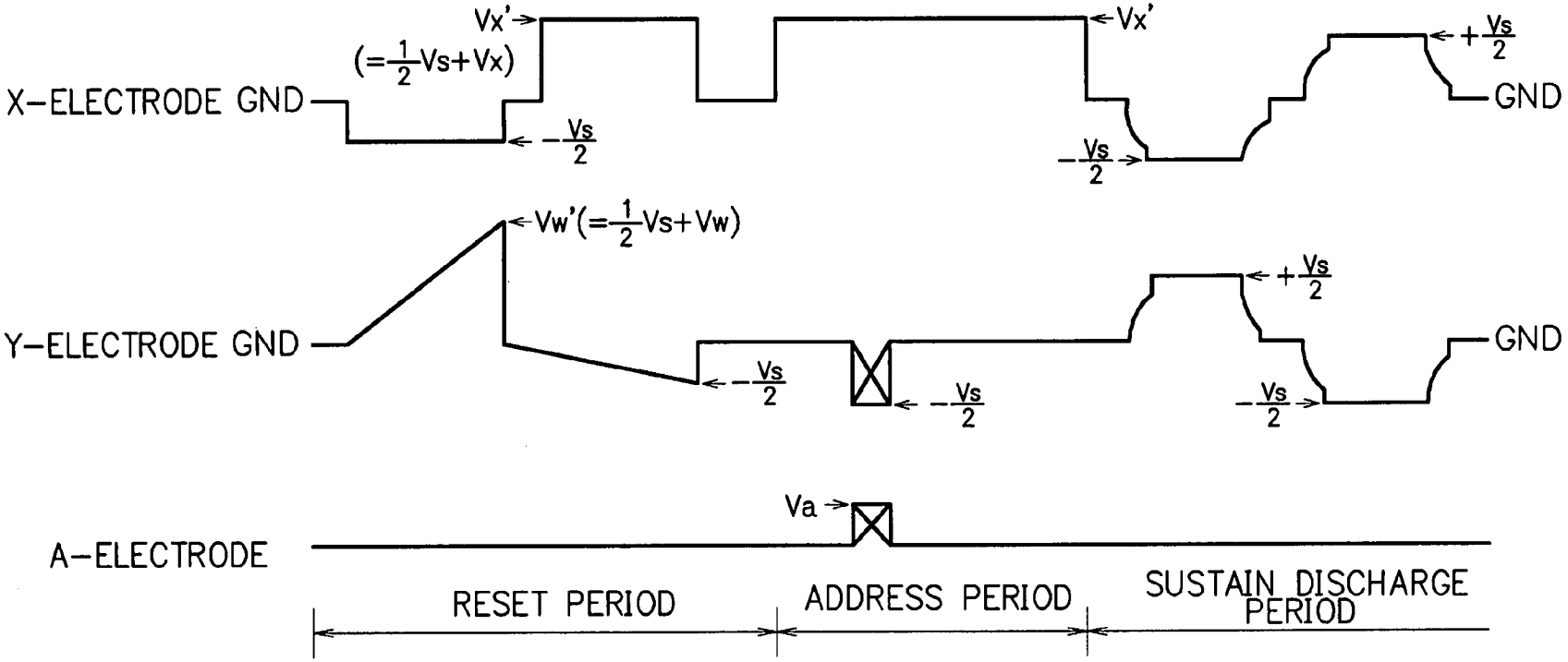
FIG. 12 is a timing chart showing the drive waveforms of the driving circuit according to the second embodiment.

FIG. 12 is a timing chart of the drive waveforms of the driving circuit shown in FIG. 11. The drive waveforms applied to the common electrode X, scanning electrode Y, and address electrode A in the reset period and address period are the same as those shown in FIG. 5, and a repetitive description will be omitted.

In the sustain discharge period shown in FIG. 12, in applying a voltage of ±Vs/2 to the common electrode X and scanning electrode Y, recovery of charges supplied to the load 20 and supply of the recovered charges are repeated using the two resonance circuits formed by the two coils L1 and L2 connected through the two diodes D2 and D3.

For example, to apply the voltage Vs/2 to the scanning electrode Y, recovered charges are supplied to the scanning electrode Y, and then, switches are controlled to increase the potential of the scanning electrode Y to Vs/2. To change the potential of the scanning electrode Y from Vs/2 to GND, charges supplied to the load 20 are recovered to drop the potential of the scanning electrode Y formed on the load 20 to almost the GND, and then, switches are controlled to drop the potential of the scanning electrode Y to the GND.

In this way, recovery of charges supplied to the load 20 and supply of the recovered charges are repeated, thereby suppressing power consumption in applying the voltage of ±Vs/2 to the common electrode X and scanning electrode Y, as shown in FIG. 12.

As described above, according to the second embodiment, in addition to the effects of the first embodiment, as the power recovery circuits 61 and 61' are arranged on the common electrode X side and on the scanning electrode Y side, the voltage to be applied to cause discharge between the common electrode X and the scanning electrode Y in the sustain discharge period can be supplied using charges recovered from the load 20 by the power recovery circuits 61 and 61', and therefore, the power consumption can be suppressed, and sustain discharge can be efficiently performed.

In the above-described first and second embodiments, the ramp wave generated by the ramp wave generation circuit 33 has its voltage that continuously changes at a constant rate with time elapsing. However, the present invention is not limited to such a ramp wave. A ramp wave may be used whose voltage continuously changes with time elapsing at a rate that varies with time elapsing. For example, a ramp wave may be used whose voltage continuously changes with time elapsing as a sign curve.

The above embodiments are mere examples of the present invention and should not be construed to limit the technical range of the present invention. That is, the present invention can be practiced in various forms without departing from its technical spirit and scope or major features.

As has been described above, according to the present invention, a ramp waveform generation circuit for generating a ramp waveform to be applied to a capacitive load serving as a display element is connected between the ground and a signal line for supplying a high-level voltage generated by a power supply circuit for generating a voltage to be applied to the capacitive load. With this arrangement, the ramp waveform generation circuit can be operated with reference to the ground potential. Hence, without using a plurality of power supply circuits or a signal transmission circuit for converting the reference potential of a control signal for the ramp waveform generation circuit, a stable ramp waveform can be output with a simple circuit arrangement.

What is claimed is:

1. A driving circuit for a flat display device, comprising:

a drive circuit applying a first, high potential voltage to a first electrode of a capacitive load serving as a display element and applying a second, low potential voltage having a phase opposite to the first voltage to the first electrode of the capacitive load, so as to make the display element emit light;

a power supply circuit for generating the first voltage and the second voltage to be applied to the capacitive load using an externally supplied power supply and supplying the first and second voltages over respective first and second signal lines to the drive circuit;

a capacitor connected between said first and second signal lines; and a ramp waveform generation circuit connected to an interconnection point between a first signal line supplying the first voltage and said capacitor so as to generate a ramp waveform to be applied to the capacitive load.

2. The driving circuit according to claim 1, wherein said ramp waveform generation circuit comprises a switching circuit and a resistor, connected to the ground.

3. The driving circuit according to claim 2, wherein said ramp waveform generation circuit further comprises a conversion circuit for converting a supplied control signal for said switching circuit to a drive level which allows said switching circuit to operate.

4. The driving circuit according to claim 2, wherein said ramp waveform generation circuit comprises a potential adjusting circuit for adjusting a final potential of the output ramp waveform.

5. The driving circuit according to claim 2, wherein said ramp waveform generation circuit comprises a ramp adjusting circuit for adjusting a ramp of the output ramp waveform.

6. The driving circuit according to claim 5, wherein said ramp adjusting circuit comprises a resistor inserted into a gate-charge loop.

7. The driving circuit according to claim 1, wherein the ramp waveform to be applied to the capacitive load changes from a positive potential to a negative potential.

8. The driving circuit according to claim 1, wherein the flat display device is an AC-driven plasma display device.

9. The driving circuit according to claim 1, wherein said ramp waveform changes in its voltage with time elapsing at a constant rate in relation to the time elapse.

10. The driving circuit according to claim 1, wherein said ramp waveform changes in its voltage with time elapsing at a rate that varies with time elapsing.

11. A driving circuit for a flat display device, applying a first voltage to a first electrode of a capacitive load serving as a display element and applying a second voltage having a phase opposite to the first voltage to the first electrode of the capacitive load, so as to make the display element emit light comprising:

first and second switching circuits connected in series between the ground and an externally supplied power supply;

a capacitor having one terminal connected to a interconnection node between said first and second switching circuits;

a third switching circuit connected between the ground and the other terminal of said capacitor; and a fourth switching circuit and a first resistor, connected in series between the ground and the interconnection node between said first and second switching circuits.

12. The driving circuit according to claim 11, further comprising a Zener diode having one terminal connected to the interconnection node between said first and second switching circuits, and said fourth switching circuit and said first resistor are connected in series between the ground and the other terminal of said Zener diode.

13. The driving circuit according to claim 11, further comprising a driver circuit for converting a supplied control signal to a drive level which allows said fourth switching circuit to operate and outputting the control signal to said fourth switching circuit.

14. The driving circuit according to claim 13, further comprising a second resistor connected in series between an output terminal of said driver circuit and a control signal input terminal of said fourth switching circuit.

15. The driving circuit according to claim 11, wherein the flat display device is an AC-driven plasma display device.

16. A driving circuit for a flat display device, comprising:

a drive circuit applying a first, high potential voltage to a first electrode of a capacitive load, serving as a display element, and applying a second, low potential voltage having a phase opposite to a phase of the first voltage to the first electrode of the capacitive load, so as to make the display element emit light;

a power supply circuit for generating the first voltage and the second voltage to be applied to the capacitive load using an externally supplied power supply and supplying the first and second voltages over respective first and second signal lines to the drive circuit;

a capacitor connected between said first and second signal lines; and a ramp waveform generation circuit connected between said first signal line supplying the first voltage and ground so as to generate a ramp waveform to be applied to the capacitive load.

* * * * *